US006834523B2

(12) United States Patent
Hinago et al.

(10) Patent No.: US 6,834,523 B2
(45) Date of Patent: Dec. 28, 2004

(54) METHOD FOR PRODUCING SEAMLESS TUBE WITH GROOVED INNER SURFACE

(75) Inventors: Nobuaki Hinago, Hatano (JP); Chikara Saeki, Hatano (JP); Kiyonori Ozeki, Hatano (JP); Hideki Iwamoto, Hatano (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 43 days.

(21) Appl. No.: 10/328,030

(22) Filed: Dec. 26, 2002

(65) Prior Publication Data

US 2003/0182979 A1 Oct. 2, 2003

(30) Foreign Application Priority Data

Mar. 28, 2002 (JP) ..... 2002-093384

(51) Int. Cl.[7] ..... B21C 37/20
(52) U.S. Cl. ..... 72/206; 72/208; 72/370.17
(58) Field of Search ..... 72/370.16, 370.17, 72/208, 77, 283, 206; 29/890.049; 420/471

(56) References Cited

U.S. PATENT DOCUMENTS

| | | | | | |
|---|---|---|---|---|---|
| 2,074,271 | A | * | 3/1937 | Peters | 72/209 |
| 3,776,018 | A | * | 12/1973 | French | 72/370.17 |
| 4,876,869 | A | * | 10/1989 | Saeki et al. | 72/68 |
| 5,164,157 | A | * | 11/1992 | Clark et al. | 420/486 |

FOREIGN PATENT DOCUMENTS

| | | | | | |
|---|---|---|---|---|---|
| JP | 58016748 | A | * | 1/1983 | B21H/1/20 |
| JP | 60003916 | A | * | 1/1985 | B21C/37/20 |
| JP | 61209723 | A | * | 9/1986 | B21C/37/15 |
| JP | 3-5882 | | | 1/1991 | |
| JP | 09052127 | A | * | 2/1997 | B21D/17/00 |
| JP | 09057328 | A | * | 3/1997 | B21C/1/22 |
| JP | 2002266042 | A | * | 9/2002 | C22C/9/06 |

* cited by examiner

*Primary Examiner*—Lowell A. Larson
(74) *Attorney, Agent, or Firm*—Oblon, Spivak, McClelland, Maier & Neustadt, P.C.

(57) ABSTRACT

Disclosed is a producing method which allows low-cost and highly productive production of a seamless tube with a grooved inner surface having a smooth outer surface and an inner surface formed with plural types of grooves such that a protrusion is not formed at the produced seamless tube with a grooved inner surface. The tube is reduced in diameter by using a die and a plug. Then, the outer surface of the tube is pressed against a grooved plug by means of a pair of rolls such that a groove is formed in a portion of the inner surface of the tube. The process flattens the cross-sectional configuration of the tube in the direction in which the tube is pressed with the rolls. Subsequently, a sizing process using a die is performed with respect to the tube such that the tube has a generally circular configuration. Then, the outer surface of the tube is pressed against a grooved plug by means of another pair of rolls disposed such that the rotation axes thereof are orthogonal to the rotation axes of the rolls, whereby a groove is formed in a portion of the inner surface of the tube. Thereafter, the tube is subjected to a diameter reducing process using a die.

14 Claims, 18 Drawing Sheets

METHOD FOR PRODUCING SEAMLESS TUBE WITH GROOVED INNER SURFACE

BACKGROUND OF THE INVENTION

1. Field of the Invention

The present invention relates to a seamless tube with a grooved inner surface preferable for a heat transfer tube to be incorporated in an air-cooled heat exchanger employed in air conditioner for home or commercial use and to a method and apparatus for producing the same. More particularly, it relates to a seamless tube with a grooved inner surface formed by a roll rolling process with excellent productivity and to a method and apparatus for producing the same.

2. Description of Related Art

As an example of a method for producing a seamless tube with a grooved inner surface, there is one using a rolling process as disclosed in JP-B No. 1991-5882. A description will be given herein below to a method for producing a seamless tube with a grooved inner surface using a roll rolling process (hereinafter referred to as a roll rolling method). As a raw material, a raw tube made of an unannealed material (H-material) is used. A grooved plug having a groove formed in the outer surface thereof is inserted into the raw tube, while a pair of rolls rotating in contact with the outer surface of the raw tube are disposed at positions corresponding to the grooved plug. The axes of rotation of the rolls are adjusted to be orthogonal to the axis of the raw tube. Each of the rolls is configured as a hollow type having a diameter larger at the center portion thereof than at the end portions thereof such that a cross-sectional configuration including the axis of rotation of the roll generally matches the configuration of the outer surface of the raw tube in a cross section orthogonal to the axis of the raw tube. By drawing the raw tube, while pressing the tube against the grooved plug by means of the rolls, the grooved plug rotates around the tube axis and the groove in the grooved plug is transferred to the inner surface of the raw tube so that a groove is formed therein.

In the roll rolling method, the grooved plug forms a groove only in a local region of the inner surface of the tube so that a load on the groove plug is smaller than in a ball rolling method. Therefore, it is also possible to form a groove parallel to the axial direction of the tube in the outer circumferential surface of the grooved plug and form a groove parallel to the axial direction of the tube in the inner surface of the tube.

However, the roll rolling method has the problem that a groove is not formed evenly in the entire inner surface of the tube. The groove is formed in the inner surface of the portion of the tube pressed by the rolls but is not formed in the inner surface of the portion of the tube not pressed by the rolls.

To solve the problem, the JP-B No. 1991-5882 discloses technology using a plurality of roll pairs each composed of two rolls such that the tube is pressed by the pairs or rolls in different directions. This allows even formation of a groove in the entire inner surface of the tube, as described in the publication.

However, the foregoing conventional technology has the following problem. In accordance with the method for producing a tube with a grooved inner surface disclosed in the JP-B No. 1991-5882, a groove is formed in the inner surface of the tube by pressing the tube in a specified direction by means of a pair of rolls and then a groove is formed in the inner surface of the tube by pressing the tube in a direction different from the foregoing specified direction by means of another pair of rolls. In this case, the following phenomenon occurs. FIGS. 19A to 19C and FIGS. 20A to 20C are cross-sectional views illustrating a conventional method for producing a seamless tube with a grooved inner surface, which are orthogonal to the tube axis. It is to be noted that the process steps shown in FIGS. 19A to 19C and FIGS. 20A to 20C are performed continuously by the same apparatus.

FIG. 19A is a cross-sectional view showing a configuration of the tube in a cross section orthogonal to the tube axis before groove formation. As shown in FIG. 19A, the tube 51 before groove formation has a generally circular cross-sectional configuration and no groove is formed in an inner surface. Then, as shown in FIG. 19B, a grooved plug 52 is inserted into the tube 51, while the tube 51 is pressed by a pair of rolls 53 being rotated outside the tube 1 in contact relation therewith. Consequently, the inner surface of the tube 51 is partly formed with a groove 59, while the tube is flattened in the direction in which it is pressed, as shown in FIG. 19C.

Next, as shown in FIG. 20A, a grooved plug 54 is inserted into the tube 51, while the tube 51 is pressed by a pair of rolls 55 being rotated outside the tube 1 in contact relation therewith. The rolls 55 press the tube 51 in a direction orthogonal to the direction in which the rolls 53 press the tube 51. Since the tube 51 has been flattened in the direction in which it is pressed by the rolls 53, a large clearance 56 is formed between the grooved plug 54 and the tube 51.

If the tube 51 is pressed by the rolls 55 in this state, a groove 60 is formed in the inner surface of the tube 51, as shown in FIG. 20B. At that time, protrusions 57 are formed at the portions of the tube 51 corresponding to the clearance between itself and the rolls 55. If a deep groove 60 is to be formed, the protrusions 57 are increased in size. If the tube 51 formed with the protrusions 57 is then subjected to a sizing process using a die or the like, the protrusions 57 are retracted into the tube so that depressed portions 58 are formed disadvantageously. As a result, the tube 51 no more has a smooth outer surface so that the commercial value of the tube 51 is reduced significantly. In FIG. 20C, the grooves 59 and 60 are not depicted.

Thus, in accordance with the method for producing a seamless tube with a grooved inner surface by performing a roll rolling process using plural pairs of rolls with respect to the tube disclosed in the JP-B No. 1991-5882, it is impossible to produce a seamless tube with a grooved inner surface which has a sufficiently high quality as a commercial product.

SUMMARY OF THE INVENTION

The present invention has been achieved in view of the foregoing problem and it is therefore an object of the present invention to provide a method for producing a seamless tube with a grooved inner surface which allows a seamless tube with a grooved inner surface having a smooth outer surface and an inner surface formed with different kinds of grooves to be produced at low cost and with high productivity, while preventing the formation of the protrusions.

A method for producing a seamless tube with a grooved inner surface according to the present invention comprises the steps of: drawing a metal tube to gradually reduce a diameter of the metal tube by means of a holding die disposed externally of the metal tube and a holding plug disposed internally of the tube and engaged with the holding die; rotating a plurality of first rolls in contact with an outer surface of the metal tube with a reduced diameter such that a rotation axis of each of the first rolls is orthogonal to an axial direction of the metal tube, while disposing, at a position inside the metal tube corresponding to the first rolls, a first grooved plug formed with a grooved outer surface and coupled in relatively rotatable relation to the holding die via a first coupling shaft, and pressing the metal tube against the first grooved plug by means of the first rolls to form a first groove in a portion of an inner surface of the metal tube in a circumferential direction of the tube and thereby form a plurality of first grooved zones; performing a sizing process with respect to the metal tube formed with the first grooved zones by using a sizing device; and rotating a plurality of second rolls in contact with the outer surface of the metal tube such that a rotation axis of each of the second rolls is orthogonal to the axial direction of the metal tube and deviates from the rotation axis of each of the first rolls, while disposing, at a position inside the metal tube corresponding to the second rolls, a second grooved plug formed with a grooved outer surface and coupled in relatively rotatable relation to the first grooved plug via a second coupling shaft, and pressing the metal tube against the second grooved plug by means of the second rolls to form a second groove in a portion of the inner surface of the metal tube in the circumferential direction of the tube and thereby form a plurality of second grooved zones.

In the present invention, the provision of the step of performing the sizing process with respect to the metal tube between the step of forming the metal tube with the first grooved zone and the step of forming the metal tube with the second grooved zone corrects the configuration of the metal tube that has been pressed and flattened by the first rolls so that the configuration of the metal tube in a cross section orthogonal to the tube axis becomes generally circular. Consequently, the clearance between the second grooved plug and the metal tube is minimized in the step of forming the second grooved zone. This prevents the formation of a protrusion at the portion of the metal tube corresponding to the space between the second rolls. As a result, a depressed portion resulting from the protrusion is not formed in the subsequent diameter reducing step and a seamless tube with a grooved inner surface having a smooth outer surface can be formed. In addition, the first grooved zone can be formed only in a portion of the inner surface of the metal tube as a result of pressing of the metal tube by means of the first rolls and then the second grooved zone can be formed in a region different from the first grooved zone as a result of pressing the metal tube by means of the second rolls. This allows the formation of a groove pattern other than a simple spiral groove in the inner surface of the metal tube.

Each of the first and second grooves may be formed in a region of the inner surface of the metal tube located between the first and second grooved zones. The arrangement allows the formation of a third region formed with each of the first and second grooves in the region located between the first and second grooved zones.

Alternatively, a groove need not be formed in a region of the inner surface of the metal tube located between the first and second grooved zones. If the seamless tube with a grooved inner surface is used as a heat transfer tube, the arrangement allows the suppression of a pressure loss in a refrigerant flowing through the tube.

Preferably, an even number of first rolls and an even number of second rolls are provided and disposed in mutually opposing relation with the metal tube interposed therebetween. For example, each of the numbers of the first rolls and the second rolls may be two. This allows a force with which one of the rolls presses the metal tube to be received by the other of the rolls opposing the roll. Accordingly, processing can be performed efficiently and the strength of the producing apparatus can be increased.

Preferably, each of respective directions in which the grooves formed in the first and second grooved plugs extend is parallel to the axial direction of the tube or inclined at an angle of 0 to 30° to the axial direction of the tube. This allows the formation of a groove parallel to the axial direction of the tube or a groove inclined to the axial direction of the tube in the inner surface of the tube. By adjusting the angle between the groove and the axial direction of the tube to less than 30°, a load applied to the grooved plug can be reduced and a loss in the grooved plug can be prevented. Since the tube is elongated in the process of reducing the diameter, the angle of the groove decreases after the diameter is reduced. The amount of the decrease of the angle depends on the ratio of reducing the diameter. The angle between the groove and the axial direction of the tube at the time of forming grooves should be about 30° in order to obtain the angle of 20° in the final stage, in a usual ratio of reducing the diameter.

Preferably, respective circumferential speeds of at least one of the first rolls and the second rolls are adjusted to be higher than a speed at which the metal tube is drawn. The arrangement achieves a reduction in frictional force produced between the first or second roll and the metal tube as well as a reduction in the drawing stress of the metal tube, thereby preventing the rupture of the metal tube reliably.

The method for producing a seamless tube with a grooved inner surface can be used preferably and appropriately if the metal is composed of copper or a copper alloy. In this case, a proof stress of the metal tube composed of copper or a copper alloy before the grooves are formed in the metal tube is preferably 200 to 500 $N/mm^2$ and a proof-stress/tensile-strength ratio of the metal tube before the grooves are formed in the metal tube is preferably 0.65 to 0.95.

By thus using the raw tube having a proof stress and a proof-stress/tensile-strength ratio falling within the foregoing ranges, the raw tube is prevented from being excessively elongated, excellent producibility is provided, and the rupture of the raw tube can be prevented, while the processing speed can be increased with the application of a large drawing force. This allows a tube with a grooved inner surface to be obtained with high productivity at low production cost. The proof stress defined herein is a 0.2% proof stress.

BRIEF DESCRIPTION OF THE DRAWINGS

FIGS. 15A to 15C are cross-sectional views illustrating a testing method for Test 1, of which FIG. 15A shows a cross-sectional configuration of the tube prior to first rolling, FIG. 15B shows a cross-sectional configuration of the tube after the first rolling and prior to a sizing process, and FIG. 15C shows a cross-sectional configuration of the tube after second rolling;

FIGS. 16A and 16B are cross-sectional views each showing the result of observing the cross-sectional configuration of the tube with a grooved inner surface by using an optical microscope, of which FIG. 16A shows the cross-sectional configuration of the tube after first rolling and FIG. 16B shows the cross-sectional configuration of the tube after the sizing process and prior to second rolling;

DETAILED DESCRIPTION OF THE PREFERRED EMBODIMENTS

Figure 1:
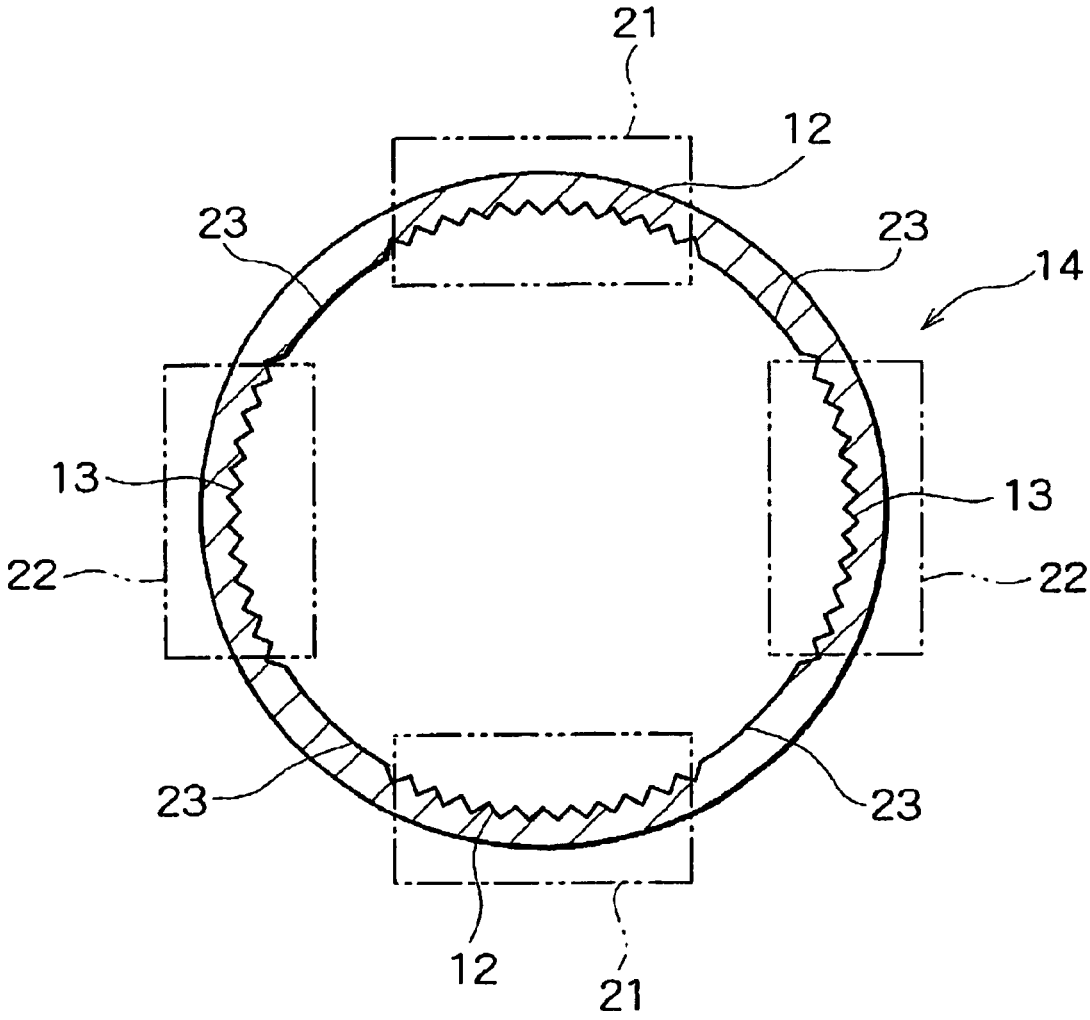
FIG. 1 is a cross-sectional view showing a structure of a seamless tube with a grooved inner surface according to a first embodiment of the present invention, which is orthogonal to the tube axis.

Referring to the drawings, a specific description will be given herein below to the embodiments of the present invention, of which a first embodiment will be described first. FIG. 1 is a cross-sectional view showing a structure of a seamless tube with a grooved inner surface according the present embodiment, which is orthogonal to the tube axis. As shown in FIG. 1, the inner surface of a tube 14 with a grooved inner surface made of copper or a copper alloy is provided with eight regions separate in the circumferential direction of the tube. Eight regions include two regions 21, two regions 22, and four regions 23 each of which extends along the axis of the tube. The two regions 21 are disposed at opposing positions in the circumferential direction of the tube, while the two regions 22 are disposed between the regions 21 in opposing relation. In a cross section of the tube 14 with a grooved inner surface which is orthogonal to the tube axis, a line connecting the respective centers of the regions 21 in the circumferential direction of the tube and a line connecting the respective centers of the regions 22 in the circumferential direction of the tube are intersecting at right angles on the axis of the tube 14 with a grooved inner surface. The four regions 23 are disposed individually between the regions 21 and the regions 22.

A groove 12 is formed in each of the regions 21 and a groove 13 is formed in each of the regions 22, while no groove is formed in each of the regions 23. In the present embodiment, the grooves 12 and 13 extend in parallel to each other in the axial direction of the tube. The respective depths, pitches, and configurations of the grooves 12 and 13 are equal to each other. The lead angle of each of the grooves 12 and 13 is, e.g., more than 0° and not more than 20°. In the cross section orthogonal to the tube axis, the highest fin has a height of 0.05 to 0.15 mm and an apex angle of, e.g., 60° to 130°.

Figure 2:
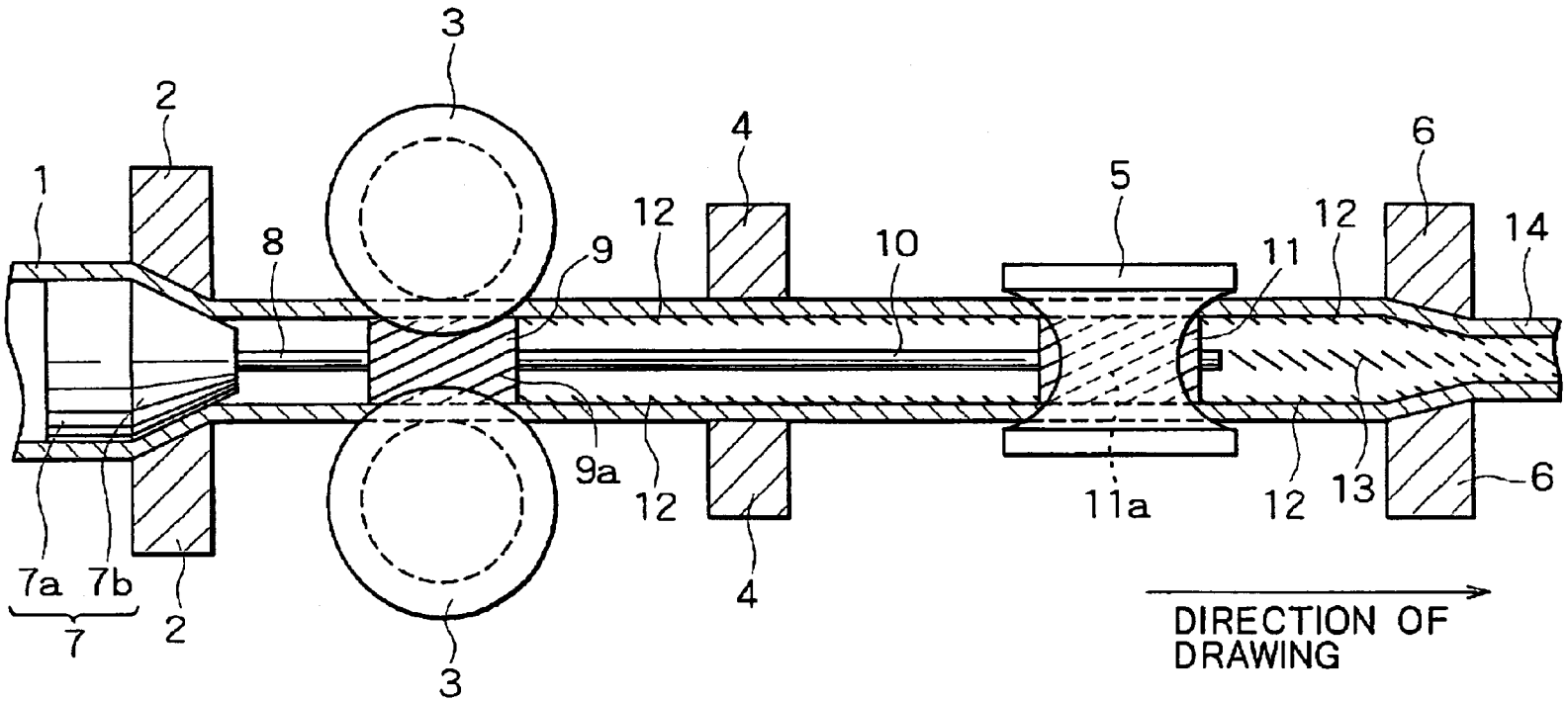
FIG. 2 is a cross-sectional view showing a structure of an apparatus for producing the seamless tube with a grooved inner surface according to the present invention.

A description will be given next to an apparatus and method for producing a seamless tube with a grooved inner surface according to the present embodiment. FIG. 2 is a cross-sectional view showing a structure of the apparatus for producing a seamless tube with a grooved inner surface according to the present embodiment. As shown in FIG. 2, a die 2 is provided to come in contact with the outer surface of a tube 1 made of copper or a copper alloy in the producing apparatus according to the present embodiment. Two rolls 3 are disposed in opposing relation with the tube 1 interposed therebetween in the direction of drawing the tube 1 when viewed from the die 2. The rolls 3 are rotatively in contact with the tube 1 such that the respective rotation axes thereof are orthogonal to the axial direction of the tube 1. The two rolls 3 have the respective rotation axes extending in parallel to each other. A die 4 is provided on the out-going side of the rolls 3 in the direction of drawing to come in contact with the outer surface of the tube 1. Two rolls 5 are disposed in mutually opposing relation with the tube 1 interposed therebetween on the out-going side of the die 4 in the direction of drawing. The rolls 5 are rotatively in contact with the tube 1 such that the respective rotation axes thereof are orthogonal to the axial direction of the tube 1 and to the direction of rotation of the rolls 3. The two rolls 5 have the respective rotation axes extending in parallel to each other. A die 6 is provided on the out-going side of the rolls 5 to come in contact with the outer surface of the tube 1.

Each of the rolls 3 and the rolls 5 is of driving type and capable of self-sustained revolution at a speed higher than the speed at which the tube 1 is drawn. For example, the circumferential speed of each of the rolls 3 and the rolls 5 can be adjusted to double the speed at which the tube 1 is drawn. The rolls 3 and the rolls 5 are pressed by respective back-up rolls (not shown). This suppresses the fluctuation of the rotation axes of the rolls 3 and the rolls 5. The back-up rolls pressing the pair of rolls 3 constitute a roller, while the back-up rolls pressing the pair of rolls 5 constitute another roller. The amount of pressing the tube 1 by means of the rolls 3 and the rolls 5 can be controlled by adjusting the pressing loads of the rolls 3 and the rolls 5 and the rolling gaps between the rolls 3 and between the rolls 5.

Figure 3:
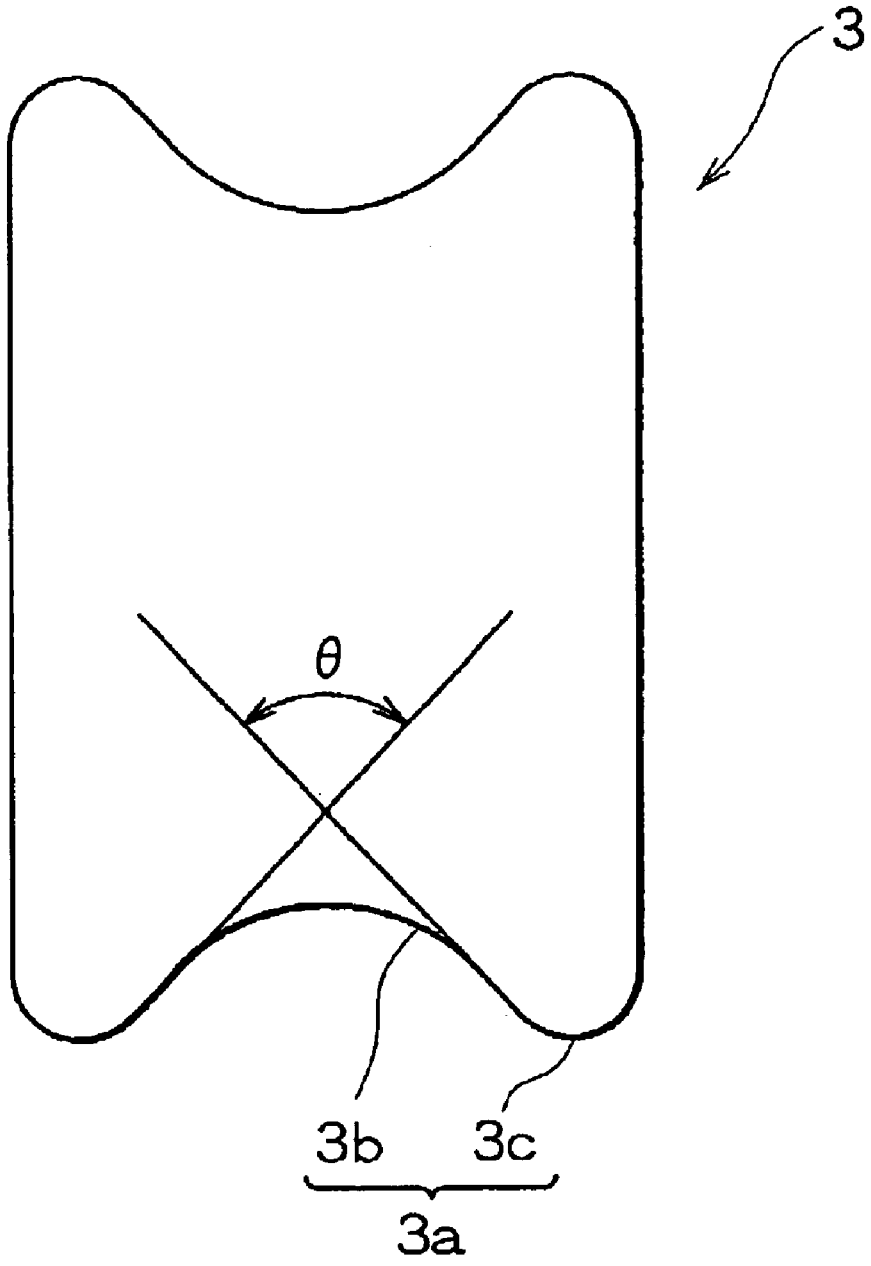
FIG. 3 is a front view showing a structure of rolls 3 in the producing apparatus shown in FIG. 2.

FIG. 3 is a front view showing a structure of each of the rolls 3. As shown in FIG. 3, depressed portions 3*b* are provided in the outer circumferential surface 3*a* of the roll 3 to extend in a circumferential direction. The region of the outer circumferential surface 3*a* other than the depressed portions 3*b* forms an outermost circumferential surface 3*c* so that the outer circumferential surface 3*a* of the roll 3 is composed of the depressed portions 3*b* and the outermost circumferential surface 3*c*. Preferably, the outer diameter of the roll 3 is about 2 to 20 times the outer diameter of the portion of the tube 1 in contact with the roll 3. The configuration of each of the depressed portions 3*b* in a cross section containing the rotation axis of the roll 3 is an arc and the radius of the arc is nearly equal to the sum of the radius of a grooved plug 9 and the wall thickness of the tube 1. The depressed portions 3*b* are formed by processing regions at an angle θ shown in FIG. 3. The angle θ is, e.g., 30° to 50°. A chamfering process has been performed with respect to the portions where the outermost circumferential surface 3*c* and the depressed portions 3*b* intersect each other. The diameter of each of the chamfered portion is preferably 0.05 times the outer diameter of the portion of the tube 1 in contact with the roll 3 or more. The rolls 3 are made of a sintered hard alloy or bearing steel. The bearing steel is an iron alloy defined in JIS G0203 to 4503, which is an alloy steel used for the ball, roller, inner and outer rings of a ball-and-roller bearing. Because of a necessity to withstand a repeated load which changes at a high speed, the bearing steel is required to have a high fatigue strength and a high wear resistance so that it is produced by placing importance on the cleanliness of the steel and the uniformity of the texture. A typical representative of the bearing steel is a high carbon, low chromium steel. A structure of each of the rolls 5 is identical to the structure of each of the rolls 3 described above.

On the other hand, a plug 7 is disposed in the tube 1 to be engaged with the die 2, as shown in FIG. 2. The plug 7 is composed of a cylindrical portion 7*a* disposed upstream in the direction of drawing the tube 1 and a truncated conical portion 7*b* coupled to the cylindrical portion 7*a* downstream thereof in the direction of drawing (on the out-going side). The cylindrical portion 7*a* has an outer diameter adjusted to be slightly smaller than the inner diameter of the tube 1 before groove formation. The truncated conical portion 7*b* has an outer diameter which is equal to that of the cylindrical portion 7*a* at the end thereof coupled to the cylindrical portion 7*a* and gradually decreases with approach toward the end thereof located on the out-going side in the direction of drawing. The truncated cylindrical portion 7*b* of the plug 7 is engaged with the die 2. The plug 7 is made of a sintered hard alloy. As the sintered hard alloy, an alloy equivalent to JIS V1 is used appropriately. A plug shaft 8 is coupled to the end of the plug 7 located on the out-going side in the direction of drawing. The plug shaft 8 has been fitted into a hole (not shown) formed in the plug 7.

A grooved plug 9 is connected to the end of the plug shaft 8 located on the out-going side in the direction of drawing. The grooved plug 9 is formed with a hole (not shown) into which the plug shaft 8 is fitted so that the grooved plug 9 is coupled rotatably to the plug shaft 8. The grooved plug 9 is kept at a specified distance from the plug 7 by the plug shaft 8 so that the grooved plug 9 is disposed at a position inside the tube 1 in alignment with the rolls 3 and forms a groove in a portion of the inner surface of the tube 1 in cooperation with the rolls 3. The grooved plug 9 has an outer diameter adjusted to a value slightly smaller than the inner diameter of the corresponding portion of the tube 1.

A groove 9*a* is formed in the outer surface of the grooved plug 9. The groove 9*a* is inclined at a given twist angle (lead angle) in the axial direction of the tube 1. The lead angle is 0° to 30°. The groove 9*a* may also have a lead angle of 0°, i.e., may be parallel to the axial direction of the tube. The depth of the groove 9*a* is 0.05 mm to 0.25 mm. This is because, if the depth of the groove 9*a* is less than 0.05 mm, sufficient heat transfer performance is hard to obtain if the tube 1 is used as a heat transfer tube and, when the depth exceeds 0.25 mm, groove formability relative to the tube 1 is reduced. A preferable apex angle of a fin formed between the grooves 9*a*, which has been inversely calculated from the final objective size of the groove formed in the inner surface of the tube 1, is 15° to 140°. The width (land width) of the upper most surface of the fin is 0.2 mm or less, preferably 0.1 mm or less. This is because, if the land width exceeds 0.2 mm, groove formability relative to the tube 1 is reduced. The grooved plug 9 is made of a sintered hard alloy and sintered hard alloys defined in, e.g., JIS V3 to V6 are used preferably as the sintered hard alloy. A plug shaft 10 is coupled to the end of the grooved plug 9 located on the out-going side in the direction of drawing. The plug shaft 10 has been fitted into a hole (not shown) formed in the grooved plug 9.

A grooved plug 11 is coupled to the end of the plug shaft 10 located on the out-going side in the direction of drawing. The grooved plug 11 is formed with a hole (not shown) into which the plug shaft 10 is to be fitted and coupled rotatably to the plug shaft 10. The grooved plug 11 is kept at a given distance from the grooved plug 9 by the plug shaft 10. As a result, the grooved plug 11 is disposed at a position inside the tube 1 in alignment with the rolls 5. The grooved plug 11 is for forming a groove in a portion of the inner surface of the tube 1 in cooperation with the rolls 5. The grooved plug 11 has an outer diameter set to a value slightly smaller than the inner diameter of the corresponding portion of the tube 1. A groove 11*a* is formed in the outer surface of the grooved plug 11. The lead angle and depth of the groove 11*a* are the same as those of the groove 9*a* in the grooved plug 9 and the apex angle and land width of a fin between the grooves 11*a* are the same as those of the fin between the grooves 9*a*. The grooved plug 11 is made of a sintered hard alloy, similarly to the groove plug 9, so that JIS V3 to V6, e.g., are used preferably as the sintered hard alloy.

Thus, in the producing apparatus according to the present embodiment, the plug 7, the plug shaft 8, the grooved plug 9, the plug shaft 10, and the grooved plug 11 are coupled in this order in a line to compose a groove plug set. The groove plug set is disposed at a given position in the tube 1 through the engagement of the plug 7 with the die 2.

Although each of the grooves 9*a* and 11*a* is depicted in FIG. 2 to have a lead angle larger than 0°, the lead angle of each of the grooves 9*a* and 11*a* is 0° in the present embodiment. The depth and pitch of the groove 9*a* are equal to those of the groove 11*a* and the apex angle and land width of the fin between the groove 9*a* are equal to those of the fin between the groove 11*a*.

Figure 4A:
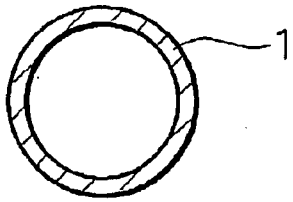
FIGS. 4A to 4C are cross-sectional views illustrating a method for producing the seamless tube with a grooved inner surface according to the present embodiment, which are orthogonal to the tube axis.
Figure 4B:
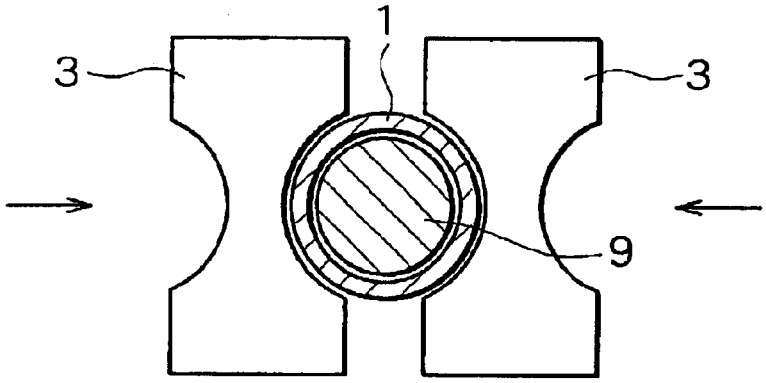
Figure 4C:
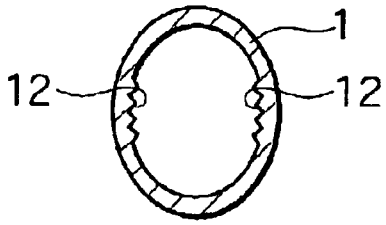

A description will be given to the method for producing a seamless tube with a grooved inner surface according to the present embodiment. FIGS. 4A to 4C and FIGS. 5A to 5C are cross-sectional views illustrating the method for producing a seamless tube with a grooved inner surface according to the present embodiment, which are orthogonal to the tube axis. First, as shown in FIG. 2, the tube 1 composed of an unannealed material (H-material) made of a metal or an alloy is reduced in diameter by the die 2 and the plug 7. At this stage, as shown in FIG. 4A, the cross-sectional configuration of the tube 1 orthogonal to the tube axis is generally circular and has no groove formed in the inner surface thereof. Next, as shown in FIGS. 2 and 4B, the outer surface of the tube 1 is pressed by the pair of rolls 3 against the grooved plug 9, whereby the groove 9*a* in the grooved plug 9 is transferred to a portion of the inner surface of the tube 1 and the groove 12 is formed in the portion of the inner surface of the tube 1, as shown in FIGS. 2 and 4C. By adjusting the amount of pressing by the rolls 3, the depth of the groove 12 and the area of the region formed with the groove 12 can be controlled. The process flattens the cross-sectional configuration of the tube 1 in the direction in which the tube 1 is pressed by the rolls 3.

Figure 5A:
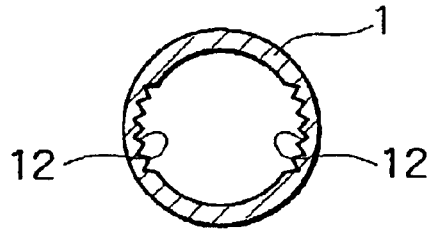
FIGS. 5A to 5C are cross-sectional views illustrating the method for producing the seamless tube with a grooved inner surface according to the present embodiment, which are orthogonal to the tube axis and show process steps subsequent to those shown in FIG. 4.
Figure 5B:
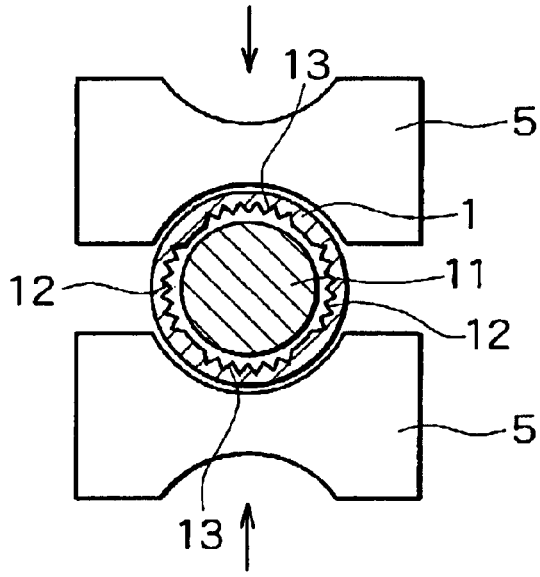
Figure 5C:
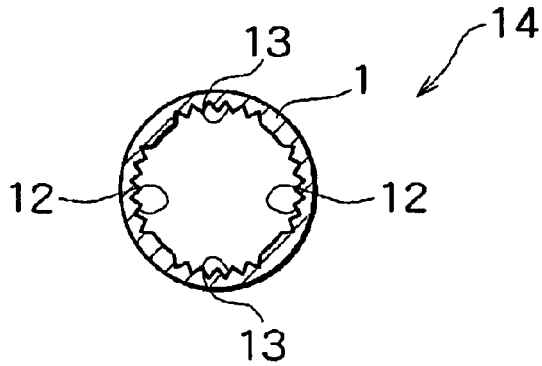

Next, as shown in FIG. 2, the sizing process using the die 4 is performed with respect to the tube 1. As a result, the configuration of the tube 1 in a cross section orthogonal to the tube axis becomes generally circular, as shown in FIG. 5A. Next, as shown in FIGS. 2 and 5B, the outer surface of the tube 1 is pressed by the pair of rolls 5 against the grooved plug 11. Consequently, the groove 11*a* in the grooved plug 11 is transferred to a portion of the inner surface of the tube 1 so that the groove 13 is formed therein. The depth of the groove 13 and the area of the region formed with the groove 13 can be controlled by adjusting the amount of pressing by the rolls 5. Subsequently, the tube 1 is subjected to a diameter reducing process using the die 6 so that a tube 14 with a grooved inner surface as shown in FIG. 5C is formed. The structure of the tube 14 with a grooved inner surface is identical with the structure of the tube 14 with a grooved inner surface shown in FIG. 1. If an annealed material (O-material) is used as the material of the tube 1, the tensile strength of the tube 1 is reduced so that elongation easily occurs. This reduces the wall thickness of the tube 1 and a rupture is likely to occur.

Figure 20A:
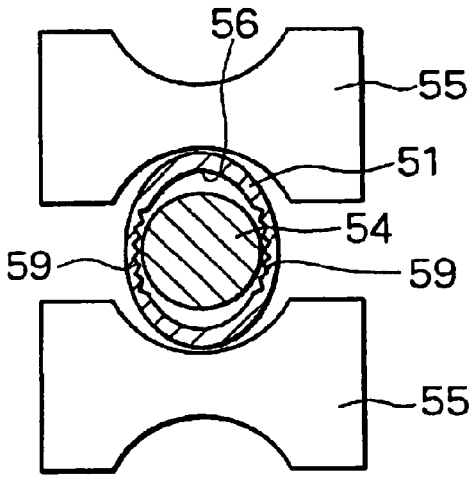
PRIOR ART FIG. 20A
FIGS. 20A to 20C are cross-sectional views illustrating the conventional method for producing a seamless tube with a grooved inner surface, which are orthogonal to the tube axis and show process steps subsequent to those shown in FIG. 19.
Figure 20B:
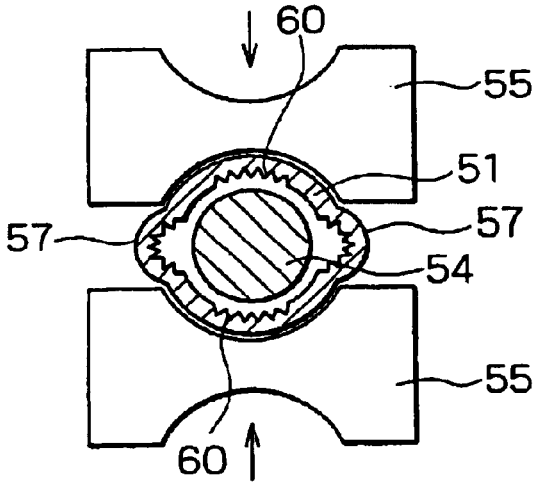
Figure 20C:
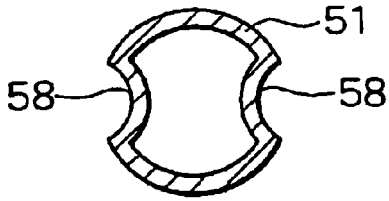

Thus, according to the present embodiment, the die 4 is provided as a sizing device in the apparatus for producing a seamless tube with a grooved inner surface, as shown in FIG. 2. After the groove 12 is formed in the inner surface of the tube 1 by using the rolls 3 and the grooved plug 9, the sizing process using the die 4 is performed with respect to the tube 1 so that the tube 1 has a generally circular configuration, as shown in FIG. 5A. This increases the outer diameter of the grooved plug 11, compared with the case where the sizing process was not performed (see FIG. 20A) in the step of forming the groove 13 in the inner surface of the tube 1 by using the rolls 5 and the grooved plug 11 shown in FIG. 5B. As a result, the clearance between the grooved plug 11 and the tube 1 is reduced in size so that the occurrence of the protrusion (see FIG. 20B) is prevented. Accordingly, the occurrence of the depressed portion (see FIG. 20C) in the outer surface of the tube 14 with a grooved inner surface after the diameter reducing step using the die 6 is performed can be prevented.

Since the present embodiment performs two rolling processes by using the two rolls 3 and the two rolls 5, respectively, the grooves extending in the axial direction of the tube 14 with a grooved inner surface can be formed in four regions extending in the axial direction of the tube, i.e., in the regions 21 and 22 as shown in FIG. 1. In addition, a flat zone can be formed in the region 23. If the tube 14 with a grooved inner surface according to the present embodiment is used as a heat transfer tube, therefore, a heat transfer tube with a low loss in the pressure of a refrigerant and with excellent evaporation performance can be obtained.

Since the grooves are formed in the inner surface of the tube 1 by the rolling processes, it is unnecessary to use a costly device such as a magnetic levitated high-speed motor or the like used in the case where rolling balls are used. This allows the production of a tube with a grooved inner surface using a simple and low-cost device. Compared with the case where rolling balls are used, a high-speed process can be performed. For example, the process can be performed at a speed of 150 m/minute. Since a tube composed of the H-material can be used as a raw tube, it is unnecessary to anneal the raw tube before groove formation. Accordingly, the production cost can be reduced significantly.

Since the lead angle of each of the grooves 12 and 13 is 20° or less, the rupture of the raw tube in the groove forming step can be prevented. Since the height of the highest fin in a cross section orthogonal to the tube axis is 0.05 to 0.15 mm and the apex angle of the fin is 60° to 130°, it is possible to provide a tube with a grooved inner surface which is excellent in both productivity and heat transfer performance.

Figure 6:
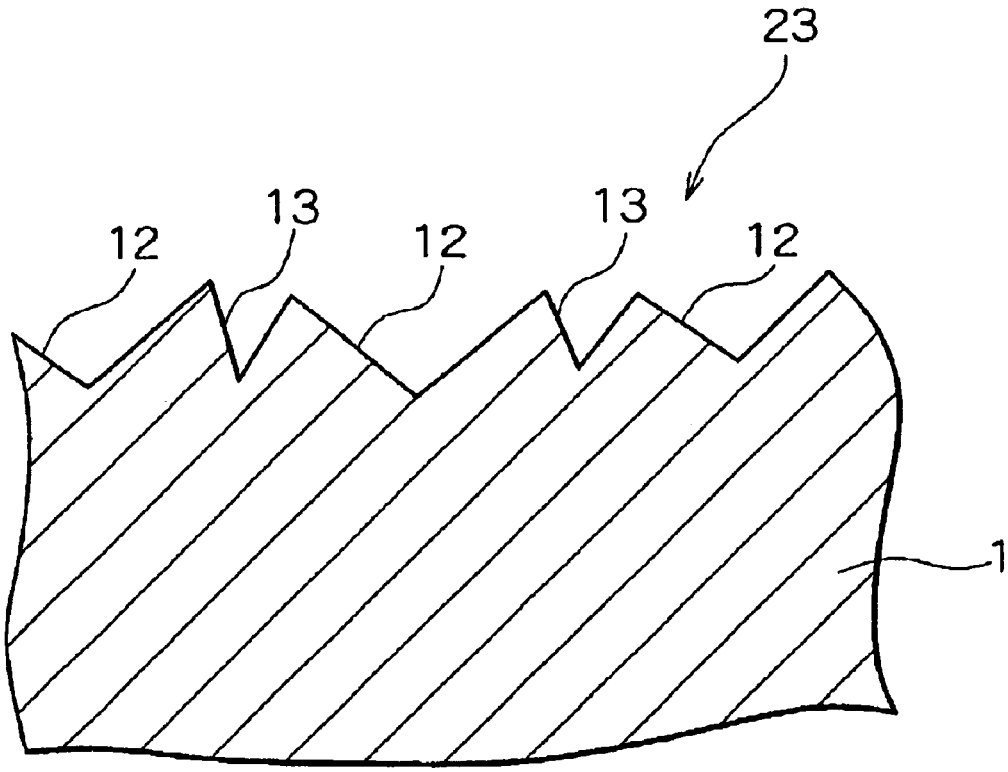
FIG. 6 is a cross-sectional view showing a structure of a seamless tube with a grooved inner surface according to a second embodiment of the present invention, which is orthogonal to the tube axis.

Next, a second embodiment of the present invention will be described. FIG. 6 is a cross-sectional view of a tube with a grooved inner surface according to the present embodiment, which is orthogonal to the tube axis. FIG. 6 shows a cross-sectional configuration of the region 23 of the tube 1 shown in FIG. 1. The present embodiment uses the apparatus shown in FIG. 2 as an apparatus for producing a seamless tube with a grooved inner surface, similarly to the foregoing first embodiment. The lead angle of each of the groove 9*a* formed in the outer surface of the grooved plug 9 and the groove 11*a* formed in the outer surface of the grooved plug 11 is 0°. The depth and pitch of the groove 9*a* are equal to the depth and pitch of the groove 11*a*. In the present embodiment, however, the amount of pressing by each of the rolls 3 and the rolls 5 is adjusted to be larger than in the first embodiment.

Accordingly, the length of the region of the inner surface of the tube 1 formed with the groove 12 in the circumferential direction of the tube and the length of the region of the inner surface of the tube 1 formed with the groove 13 in the circumferential direction of the tube become longer than in the first embodiment so that each of the grooves 12 and 13 is formed in the region 23. Consequently, the region 23 is formed with grooves having the same lead angles as the grooves 12 and 13 and pitches different from those of the grooves 12 and 13. Since each of the grooves 12 and 13 is formed in the region 23, as shown in FIG. 6, the pitches are reduced.

Figure 7A:
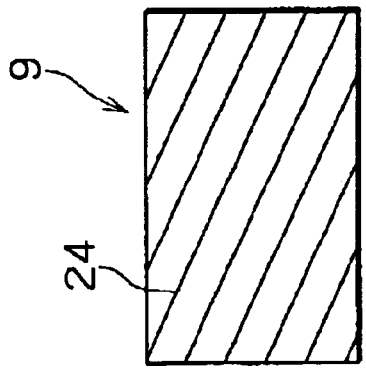
FIGS. 7A and 7B are views diagrammatically showing the groove patterns of a grooved plug in an apparatus for producing a tube with a grooved inner surface according to a third embodiment of the present invention and FIG. 7C is a development view of the inner surface of the tube with a grooved inner surface according to the present embodiment.
Figure 7B:
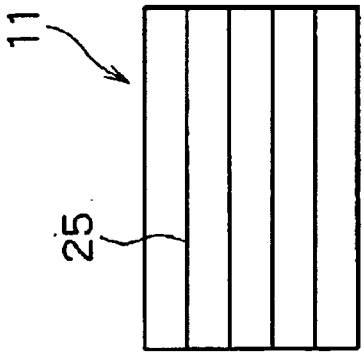
Figure 7C:
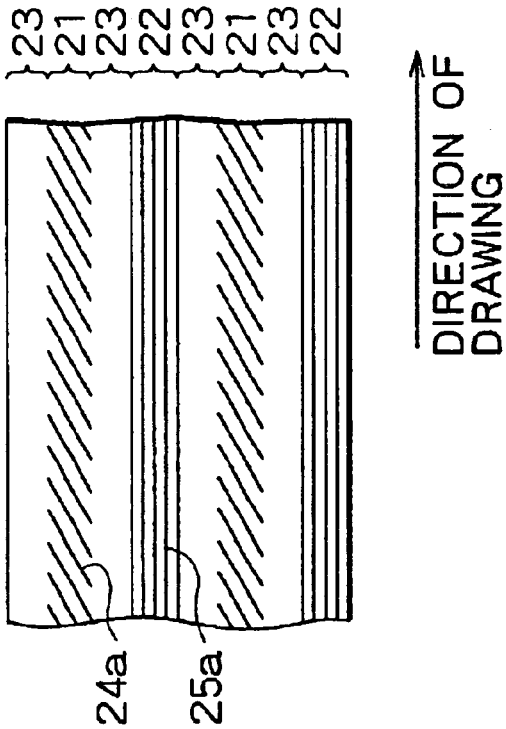

Next, a third embodiment of the present invention will be described. FIGS. 7A and 7B are views diagrammatically showing the groove patterns of the grooved plugs in the apparatus for producing a tube with a grooved inner surface according to the present embodiment. FIG. 7C is a development view of the inner surface of a tube with a grooved inner surface according to the present embodiment. In FIGS. 7A to 7C, the left-to-right direction in each of the drawings coincides with the direction of drawing the tube. The present embodiment also uses the apparatus shown in FIG. 2 as an apparatus for producing a seamless tube with a grooved inner surface. However, a grooved plug having an outer surface formed with the groove pattern shown in FIG. 7A is used as the grooved plug 9 and a grooved plug having an outer surface formed with the groove pattern shown in FIG. 7B is used as the grooved plug 11. Specifically, the groove 24 shown in FIG. 7A is a spiral groove having a lead angle larger than 0° and the groove 25 shown in FIG. 7B is a straight groove having a lead angle of 0°.

Figure 8:
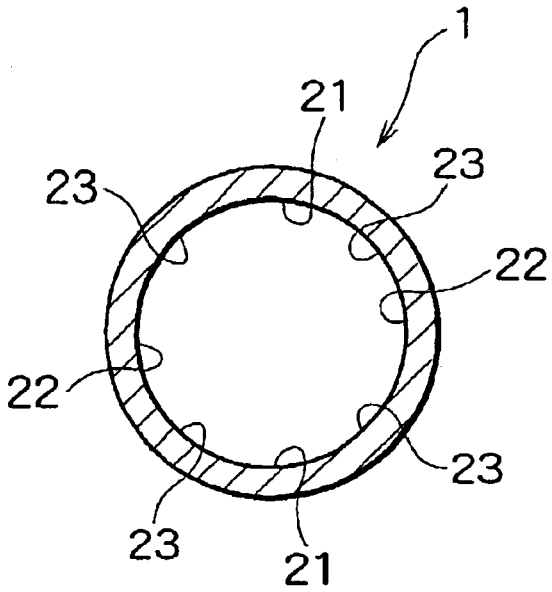
FIG. 8 is a cross-sectional view showing the positional relationship between the regions 21 to 23 of the inner surface of the tube.

As a result, as shown in FIG. 7C, the groove 24 in the grooved plug 9 is transferred to each of the regions 21 of the inner surface of the tube 1 to form a groove 24*a* therein and the groove 25 in the grooved plug 11 is transferred to each of the regions 22 of the inner surface of the tube 1 to form a straight groove 25*a* therein, while each of the regions 23 of the inner surface of the tube 1 has no groove formed therein to form a flat zone. If the tube 1 is used as a heat transfer tube, the heat transfer tube obtained is excellent in both evaporation performance and condensation performance. FIG. 8 is a cross-sectional view showing the positional relationship between the regions 21 to 23 of the inner surface of the tube 1.

The lead angle of the groove 24*a* is, e.g., larger than 0° and not more than 20°. In a cross sectional orthogonal to the tube axis, the height of the highest fin is, e.g., 0.05 to 0.15 mm and the apex angle of the fin is, e.g., 60° to 130°. The lead angle of the groove 25*a* is 0°. In a cross section orthogonal to the tube axis, the height of the highest fin is, e.g., 0.05 to 0.15 mm and the apex angle of the fin is, e.g., 60° to 130°.

Figure 9:
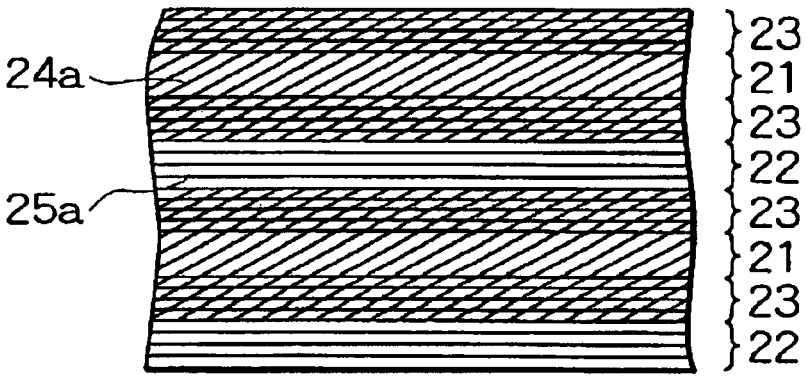
FIG. 9 is a development view of the inner surface of a tube with a grooved inner surface according to a fourth embodiment of the present invention.

Next, a fourth embodiment of the present invention will be described. FIG. 9 is a development view of the inner surface of a tube with a grooved inner surface according to the present embodiment. The present embodiment uses the apparatus shown in FIG. 2 as an apparatus for producing a seamless tube with a grooved inner surface, similarly to the foregoing third embodiment. However, the grooved plug having the outer surface formed with the groove pattern shown in FIG. 7A is used as the grooved plug 9 and the grooved plug having the outer surface formed with the groove pattern shown in FIG. 7B is used as the grooved plug 11. In the present embodiment, however, the amount of pressing by each of the rolls 3 and the rolls 5 is adjusted to be larger than in the foregoing third embodiment.

Consequently, as shown in FIG. 9, the spiral groove 24*a* is formed in each of the regions 21 of the inner surface of the tube 1 and the straight groove 25*a* is formed in each of the regions 22 of the inner surface of the tube, while each of the regions 23 of the inner surface of the tube 1 is formed with each of the spiral groove 24*a* and the straight groove 25*a*. In short, the region 23 is formed with cross grooves composed of the spiral groove 24*a* and the straight groove 25*a* intersecting each other.

Figure 10A:
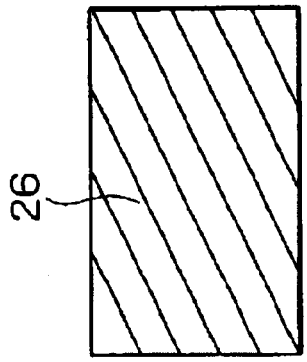
FIGS. 10A and 10B are views diagrammatically showing the groove patterns of a grooved plug in an apparatus for producing a tube with a grooved inner surface according to a fifth embodiment of the present invention and FIG. 10C is a development view of the inner surface of the tube with a grooved inner surface according to the present embodiment.
Figure 10B:
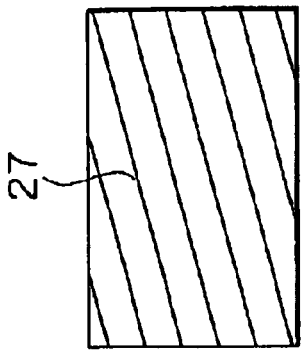
Figure 10C:
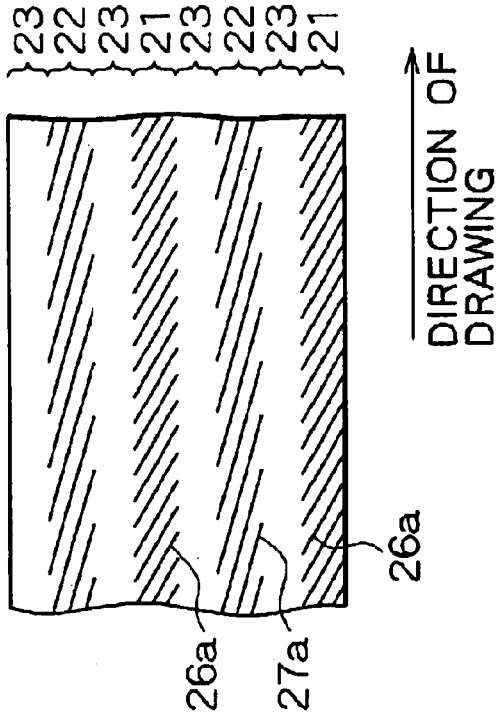

Next, a fifth embodiment of the present invention will be described. FIGS. 10A and 10B are views diagrammatically showing the groove patterns of the grooved plugs in an apparatus for producing a tube with a grooved inner surface according to the present embodiment. FIG. 10C is a development view of the inner surface of the tube with a grooved inner surface according to the present embodiment. The present embodiment uses the apparatus shown in FIG. 2 as an apparatus for producing a seamless tube with a grooved inner surface, uses a grooved plug having an outer surface formed with the groove pattern shown in FIG. 10A as the grooved plug 9, and uses a grooved plug having an outer surface formed with the groove pattern shown in FIG. 10B as the grooved plug 11. Specifically, a spiral groove 26 is formed in the outer surface of the grooved plug 9 and a spiral groove 27 is formed in the outer surface of the grooved plug 11 such that the spiral grooves 26 and 27 are inclined in the same direction relative to the axial direction of the tube 1.

Consequently, a groove 26*a* is formed in each of the regions 21 of the inner surface of the tube 1 and a groove 27*a* is formed in each of the regions 22 of the inner surface of the tube 1, while each of the regions 23 of the inner surface of the tube 1 has no groove formed therein to form a flat zone, as shown in FIG. 10C. The lead angle of each of the grooves 26*a* and 27*a* is, e.g., larger than 0° and not more than 20°. In a cross section orthogonal to the tube axis, the height of the highest fin is, e.g., 0.05 to 0.15 mm and the apex angle of the fin is, e.g., 60° to 130°.

Figure 11:
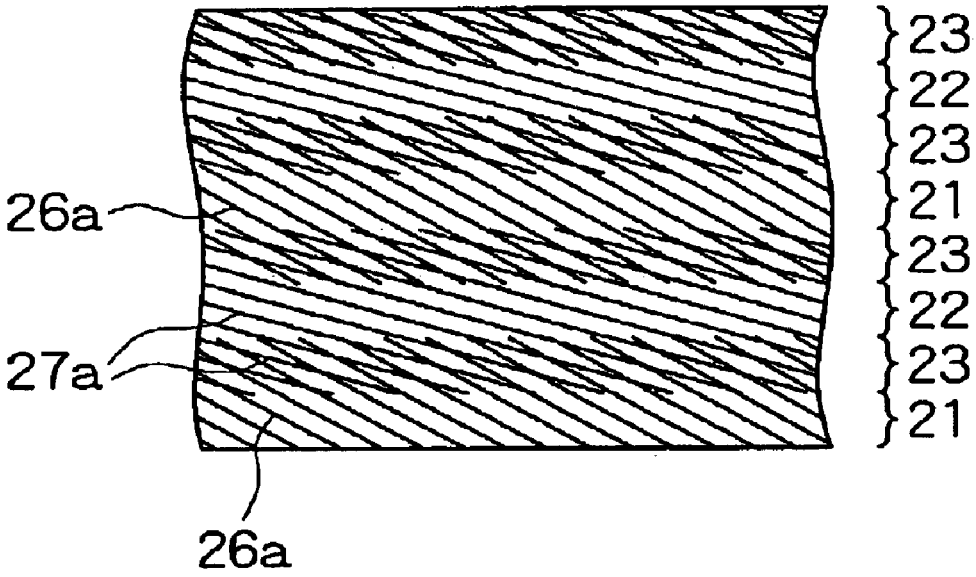
FIG. 11 is a development view of the inner surface of a tube with a grooved inner surface according to a sixth embodiment of the present invention.

Next, a sixth embodiment of the present invention will be described. FIG. 11 is a development view of the inner surface of a tube with a grooved inner surface according to the present embodiment. The present embodiment uses the apparatus shown in FIG. 2 as an apparatus for producing a seamless tube with a grooved inner surface, uses the grooved plug having the outer surface formed with the groove pattern shown in FIG. 10A as the grooved plug 9, and uses the grooved plug having the outer surface formed with the groove pattern shown in FIG. 10B as the grooved plug 11, similarly to the foregoing fifth embodiment. In the present embodiment, however, the amount of pressing by each of the rolls 3 and the rolls 5 is adjusted to be larger than in the fifth embodiment.

Consequently the groove 26*a* is formed in each of the regions 21 of the inner surface of the tube 1 and the groove 27*a* is formed in each of the regions 22 of the inner surface of the tube 1, while each of the regions 23 of the inner surface of the tube 1 is formed with each of the grooves 26*a* and 27*a* to form a cross-grooved zone, as shown in FIG. 11.

Although each of the foregoing fifth and sixth embodiment has shown an example in which the groove 26 formed in the outer surface of the groove plug 9 and the groove 27 formed in the outer surface of the grooved plug 11 are inclined in the same direction relative to the axial direction of the tube 1, the grooves 26 and 27 may also be inclined in mutually opposite directions relative to the axial direction of the tube 1.

Figure 12A:
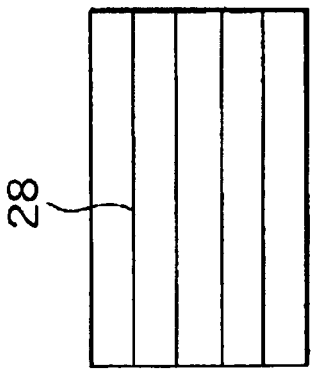
FIGS. 12A and 12B are views diagrammatically showing the groove patterns of a grooved plug in an apparatus for producing a tube with a grooved inner surface according to a seventh embodiment of the present invention and FIG. 12C is a development view of the inner surface of the tube with a grooved inner surface according to the present embodiment.
Figure 12B:
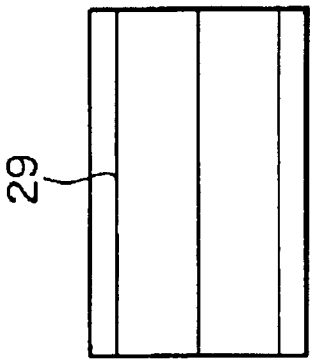
Figure 12C:
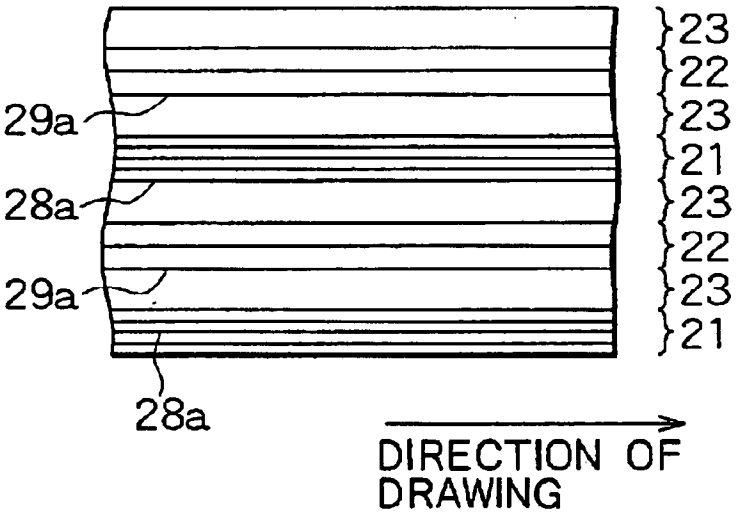

Next, a seventh embodiment of the present invention will be described. FIGS. 12A and 12B are views diagrammatically showing the groove patterns of the grooved plugs in an apparatus for producing a tube with a grooved inner surface according to the present embodiment. FIG. 12C is a development view of the inner surface of the tube with a grooved inner surface according to the present embodiment. The present embodiment uses the apparatus shown in FIG. 2 as an apparatus for producing a seamless tube with a grooved inner surface, uses a grooved plug having an outer surface formed with the groove pattern shown in FIG. 12A as the grooved plug 9, and uses a grooved plug having an outer surface formed with the groove pattern shown in FIG. 12B as the grooved plug 11. Specifically, a straight groove 28 having a low pitch is formed in the outer surface of the grooved plug 9 and a straight groove 29 having a pitch higher than that of the straight groove 28 is formed in the outer surface of the grooved plug 11.

Consequently, the straight groove 28 is transferred to each of the regions 21 of the inner surface of the tube 1 to form a groove 28*a* therein and the straight groove 29 is transferred to the region 22 of the inner surface of the tube 1 to form a groove 29*a* therein, while each of the regions 23 of the inner surface of the tube 1 has no groove formed therein to form a flat zone, as shown in FIG. 12C. The groove 28*a* having a low pitch is effective in improving the evaporation performance of a heat transfer tube, while the groove 29*a* having a high pitch is effective in improving the condensation performance of the heat transfer tube. The lead angle of each of the grooves 28*a* and 29*a* is 0°. In a cross section orthogonal to the tube axis, the height of the highest fin is, e.g., 0.05 to 0.15 mm and the apex angle of the fin is, e.g., 60° to 130°.

Although the present embodiment has shown an example in which each of the regions 23 is formed as a flat zone by relatively reducing the amount of pressing by each of the rolls 3 and the rolls 5, it is possible to form each of the grooves 28*a* and 29*a* in the region 23 by increasing the amount of pressing by each of the rolls 3 and the rolls 5. It is also possible to form spiral grooves having different pitches in the respective outer surfaces of the grooved plugs 9 and 11 such that the groove having a low pitch and inclined to the axial direction of the tube is formed in each of the regions 21 and the groove having a high pitch and inclined to the axial direction of the tube is formed in each of the regions 22. The region 23 may be formed as either a flat zone or a cross-grooved zone where the aforementioned two kinds of spiral grooves intersect each other.

Figure 13:
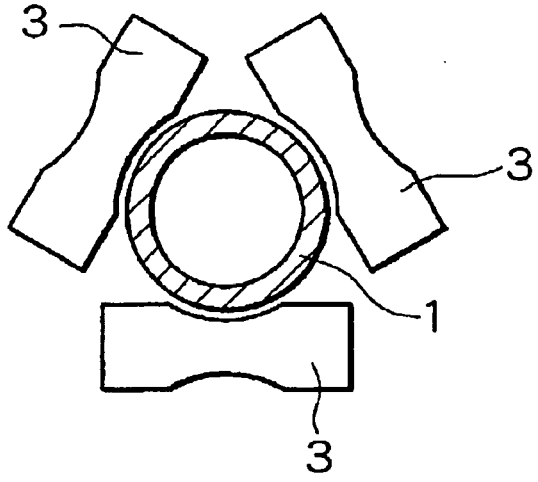
FIG. 13 is a front view showing a structure of a roll in an apparatus for producing a tube with a grooved inner surface according to an eighth embodiment of the present invention.

Next, an eighth embodiment of the present invention will be described. FIG. 13 is a front view showing a structure of the rolls in an apparatus for producing a tube with a grooved inner surface according to the present embodiment. The structure of the producing apparatus according to the present embodiment is the same as that of the producing apparatus shown in FIG. 2 except for the structure of the rolls 3 and the rolls 5. As shown in FIG. 13, three rolls 3 are provided in the present embodiment such that they are disposed with a 120° spacing when viewed from the axis of the tube 1 to rotate in contact with the outer surface of the tube 1. Three rolls 5 are also provided, similarly to the rolls 3. The rolls 3 and the rolls 5 are positioned such that the regions of the outer surface of the tube 1 in contact with the rolls 3 deviate from the regions of the tube 1 in contact with the rolls 5. As a result, the inner surface of the tube 1 is in contact with the grooved plugs 9 and 11 at three positions so that each of the two kinds of grooved zones is formed at three positions.

Figure 14:
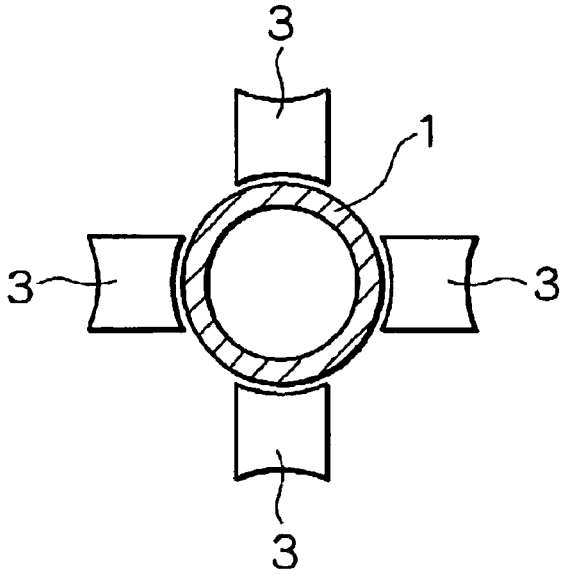
FIG. 14 is a front view showing a structure of rolls in an apparatus for producing a tube with a grooved inner surface according to a ninth embodiment of the present invention.

Next, a ninth embodiment of the present invention will be described. FIG. 14 is a front view showing a structure of the rolls in an apparatus for producing a tube with a grooved inner surface according to the present embodiment. The structure of the producing apparatus according to the present embodiment is the same as that of the producing apparatus shown in FIG. 2 except for the structure of the rolls 3 and the rolls 5. As shown in FIG. 14, four rolls 3 are provided in the present embodiment such that they are disposed with a 90° spacing when viewed from the axis of the tube 1 to rotate in contact with the outer surface of the tube 1. Four rolls 5 are also provided, similarly to the rolls 3. The rolls 3 and the rolls 5 are positioned such that the regions of the outer surface of the tube 1 with which the rolls are in contact deviate from the regions of the tube 1 with which the rolls 5 are in contact. As a result, the inner surface of the tube is in contact with the grooved plugs 9 and 11 at four positions so that each of the two kinds of grooved zones is formed at four positions.

Although each of the eighth and ninth embodiments has shown an example in which the rolls 3 and the rolls 5 provided are equal in number, the rolls 3 and the rolls 5 need not necessarily be equal in number. By providing the rolls 3 and the rolls 5 in different numbers, the inner surface of the tube 1 has a more complicated configuration.

Although each of the first to ninth embodiments has shown an example in which the die 4 (see FIG. 2) is used as a sizing device, rolls may be used instead as a sizing device. Although each of the first to ninth embodiments has shown an example in which the two pairs of rolls (the rolls 3 and the rolls 5) are provided and the dies 4 and 6 are provided on the out-going sides of the rolls 3 and the rolls 5 in the direction of drawing, respectively, three or more pairs of rolls may also be provided. This allows the formation of three or more kinds of grooved zones in the inner surface of the tube 1. However, a sizing device such as a die should necessarily be provided on the out-going side of each pair of rolls. In other words, the number of sizing devices should be equal to or more than the number of pairs of the rolls.

Next, a tenth embodiment of the present invention will be described. FIG. 1 is a cross-sectional view showing a structure of a tube with a grooved inner surface according to the present embodiment, which is orthogonal to the tube axis. A tube 14 with a grooved inner surface according to the present embodiment is made of copper or a copper alloy., e.g., pure copper such as OFC (Oxygen Free Copper) or phosphor-deoxidized copper. As pure copper, Alloy C1020 defined in JISH3300, e.g., is used. As the phosphor-deoxidized copper, Alloy C1220 defined in JISH3300, e.g., is used. It is also possible to use a copper alloy prepared by doping copper (Cu) with 0.01 to 3.0 mass % of one metal or two or more metals selected from the group consisting of P, Sn, Fe, Zn, Mn, Al, Si, Ti, Pb, Zr, Co, and Cr.

As shown in FIG. 1, the inner surface of the tube 14 with a grooved inner surface is provided with, e.g., four grooved zones. Specifically, the inner surface of the tube 14 with a grooved inner surface is formed with eight regions separate in the circumferential direction of the tube including the two regions 21, the two regions 22, and the four regions 23. The regions 21 to 23 extend along the axis of the tube. The two regions 21 are disposed at opposing positions in the circumferential direction of the tube, while the two regions 22 are disposed in mutually opposing relation between the regions 21. In a cross section orthogonal to the axis of the tube 14 with a grooved inner surface, a line connecting the respective centers of the regions 21 in the circumferential direction and a line connecting the respective centers of the regions 22 in the circumferential direction are intersecting at right angles on the axis of the tube 14 with a grooved inner surface. The four regions 23 are disposed individually between the regions 21 and 22.

Each of the regions 21 is formed with the groove 12 and each of the regions 22 is formed with the groove 13, while no groove is formed in each of the regions 23. In the present embodiment, the grooves 12 and 13 extend in parallel in the axial direction of the tube and the respective depths, pitches, and configurations of the grooves 12 and 13 are equal to each other. The lead angle of each of the grooves 12 and 13 is, e.g., 18° or less. In a cross section orthogonal to the tube axis, the height of the highest fin is 0.05 to 0.18 mm. The thickness of the bottom wall is, e.g., 0.1 to 0.4 mm. Although the present embodiment has shown an example in which the regions 23 have no groove formed therein, the regions 23 may also be formed with the groove 12 or 13. Alternatively, the regions 23 may be formed with each of the grooves 12 and 13 to form cross-grooved zones. The number of the grooved zones is not limited to 4 and may be 1 or more.

A description will be given to a method for producing a tube with a grooved inner surface according to the present embodiment. FIG. 2 is a cross-sectional view showing a structure of an apparatus for producing the tube with a grooved inner surface according to the present embodiment. In the producing apparatus according to the present embodiment, the die 2 is provided to come in contact with the outer surface of the tube 1 made of copper or a copper alloy such that the two rolls 3 are disposed in opposing relation in the direction of drawing the tube 1 when viewed from the die 2, as shown in FIG. 2. Each of the rolls 3 is configured as an hourglass having an outer diameter which is smaller at the center portion thereof than at the end portions thereof in the axial direction and rotates in contact with the tube 1 with its rotation axis orthogonal to the axial direction of the tube 1. The two rolls 3 have their rotation axes parallel to each other. The die 4 is provided to come in contact with the outer surface of the tube 1 on the out-going side (downstream) of the rolls 3 in the direction of drawing. The two rolls 5 are disposed in opposing relation with the tube 1 interposed therebetween on the out-going side of the die 4 in the direction of drawing. Each of the rolls 5 is configured as an hourglass having an outer diameter which is smaller at the center portion thereof than at the end portions thereof in the axial direction and rotates in contact with the tube 1 with its rotation axis orthogonal to the axial direction of the tube 1. The two rolls 5 have their rotation axes parallel to each other. Although the rolls 5 are depicted to have respective rotation axes orthogonal to the respective rotation axes of the rolls 3 in FIG. 2, the tube 1 is twisted in an actual situation by a rolling process using the rolls 3 so that it is necessary to adjust the positions of the rolls 5 depending on the amount of twisting. Therefore, the rotation axes of the rolls 5 are not necessarily orthogonal to the rotation axes of the rolls 3. A die 6 is provided on the out-going side of the rolls 5 to come in contact with the outer surface of the tube 1.

On the other hand, the plug 7 is disposed in the tube 1 to be engaged with the die 2, as shown in FIG. 2. The plug 7 is composed of a cylindrical portion 7*a* disposed upstream in the direction of drawing the tube 1 and a truncated conical portion 7*b* coupled to the cylindrical portion 7*a* downstream thereof in the direction of drawing (on the out-going side). The cylindrical portion 7*a* has an outer diameter adjusted to be slightly smaller than the inner diameter of the tube 1 before it passes through the die 2. The truncated conical portion 7*a* has an outer diameter which is equal to that of the cylindrical portion 7*a* at the end thereof coupled to the cylindrical portion 7*a* and gradually decreases with approach toward the end thereof located on the out-going side in the direction of drawing. The truncated cylindrical portion 7*b* of the plug 7 is engaged with the die 2. The plug shaft 8 is coupled to the end of the plug 7 located on the out-going side in the direction of drawing.

The grooved plug 9 is coupled to the end of the plug shaft 8 on the out-going side in the direction of drawing such that it is rotatable relative to the plug shaft 8. The grooved plug 9 is kept at a specified distance from the plug 7 by the plug shaft 8 so that the grooved plug 9 is disposed at a position inside the tube 1 in alignment with the rolls 3 and forms a groove in a portion of the inner surface of the tube 1 in cooperation with the rolls 3. The grooved plug 9 has an outer diameter adjusted to a value slightly smaller than the inner diameter of the corresponding portion of the tube 1. The groove 9*a* is formed in the outer surface of the grooved plug 9. The groove 9*a* is inclined at a given spiral angle (lead angle) in the axial direction of the tube 1.

The grooved plug 11 is coupled to the end of the plug shaft 10 located on the out-going side in the direction of drawing such that it is rotatable relative to the plug shaft 10. The grooved plug 11 is kept at a given distance from the grooved plug 9 by the plug shaft 10. As a result, the grooved plug 11 is disposed at a position inside the tube 1 in alignment with the rolls 5. The grooved plug 11 is for forming a groove in a portion of the inner surface of the tube 1 in cooperation with the rolls 5. The grooved plug 11 has an outer diameter set to a value slightly smaller than the inner diameter of the corresponding portion of the tube 1. The groove 11*a* is formed in the outer surface of the grooved plug 11.

Thus, in the producing apparatus according to the present embodiment, the plug 7, the plug shaft 8, the grooved plug 9, the plug shaft 10, and the grooved plug 11 are coupled in this order in a line to compose a groove plug set. The groove plug set is disposed at a given position in the tube 1 through the engagement of the plug 7 with the die 2.

A description will be given to the method for producing a seamless tube with a grooved inner surface according to the present embodiment. First, the tube 1 shown in FIG. 2 is produced. Copper or a copper alloy as described above is cast into a billet and held at a temperature of 750° to 900° for 1 minute to 1 hour. Then, hot extrusion is performed at a temperature of 750° to 900°, followed by immediate water cooling. At that time, a cooling rate in the temperature range of 700° to 300° C. is adjusted to 1.5° C./second or more. Although it is possible to gradually cool the extruded material without performing water cooling, water cooling is preferably performed to prevent the occurrence of a flaw and provide the material in which the crystal grains have equal diameters.

Next, the cooled material is rolled and drawn to produce the tube 1. At that time, the mechanical properties of the tube 1 are controlled into a specified range by adjusting the respective working ratios of the foregoing rolling and drawing processes. The tube 1 is formed from an unannealed material (H-material). The proof stress of the tube 1 is 200 to 500 N/mm$^2$ and the proof-stress/tensile-strength ratio thereof is 0.65 to 0.95. The diameters of the crystal grains of copper or a copper alloy forming the tube 14 with a grooved inner surface are preferably, e.g., 10 $\mu$m or less as values measured by a cut-off method defined in JISH0501. Table 1 shows an example of the mechanical properties of the tube 1. For a comparison, Table 1 also shows the mechanical properties of an annealed material used as a raw tube in a ball rolling method and a conventional roll rolling method. The mechanical properties shown in Table 1 are measured by preparing a test sample No. 11 defined in JISZ220 in accordance with a measuring method defined in JISZ2241. It is to be noted that the values enclosed in the parentheses shown in Table 1 indicate normal ranges for the mechanical properties of the annealed material.

TABLE 1

| Material | Tensile Strength (N/mm$^2$) | Elongation (%) | Proof Stress (N/mm$^2$) | Proof-Stress/ Tensile strength Ratio | Diameter of Crystal Grain ($\mu$m) |
|---|---|---|---|---|---|
| H-Material | 360 | 16 | 270 | 0.75 | Processed Texture |
| Annealed Material | 260 (220 to 300) | 50 (40 or More) | 100 (80 to 150) | 0.38 | 20 |

The resulting tube 1 is loaded in the producing apparatus shown in FIG. 2, whereby the tube 1 is first reduced in diameter by the die 2 and the plug 7. At that time, the tube 1 has a generally circular cross-sectional configuration orthogonal to the tube axis and has no groove formed in the inner surface thereof. Then, the outer surface of the tube 1 is pressed by the pair of rolls 3 against the grooved plug 9, whereby the groove 9*a* in the grooved plug 9 is transferred to a portion of the inner surface of the tube 1 and the groove 12 is formed in the portion of the inner surface of the tube 1. At that time, the depth of the groove 12 and the area of the region formed with the groove 12 can be controlled by adjusting the amount of pressing by the rolls 3. By the process, the cross-sectional configuration of the tube 1 is flattened in the direction in which the tube 1 is pressed by the rolls 3.

Next, a sizing process is performed by the die 4 with respect to the tube 1. Consequently, the tube 1 has a generally circular configuration in a cross section orthogonal to the tube axis. Next, the pair of rolls 5 press the outer surface of the tube 1 against the grooved plug 11. As a result, the groove 11*a* in the grooved plug 11 is transferred to a portion of the inner surface of the tube 1 so that the groove 13 is formed therein. The depth of the groove 13 and the area of the region formed with the groove 13 can be controlled by adjusting the amount of pressing by the rolls 5. The tube 1 is then reduced in diameter by the die 6. Thereafter, annealing is performed, whereby the tube 14 with a grooved inner surface shown in FIG. 1 is formed. If an annealed material (O-material) is used as the material of the tube 1 in the present embodiment, the tensile strength of the tube 1 is reduced so that elongation easily occurs. This reduces the wall thickness of the tube 1 and a rupture is likely to occur.

A description will be given herein below to the reason for limiting values in requirements placed on individual components of the present invention.

Proof Stress of Copper or Copper Alloy before Groove Formation: 200 to 500 N/mm$^2$ If the proof stress of the tube before groove formation is less than 200 N/mm$^2$, the tube is more likely to elongate and the wall thickness thereof is extremely reduced so that a rupture is more likely to occur. If the proof stress of the tube before groove formation is more than 500 N/mm$^2$, on the other hand, the tube is less likely to elongate and the material is less likely to flow into the grooves in the grooved plugs so that the groove formability is reduced. To form the grooves having objective configurations, the pressing forces of the rolls and the tube drawing force should inevitably be increased so that the rupture of the tube is more likely to occur. Hence, the proof stress of the copper or copper alloy tube before groove formation is adjusted to 200 to 500 N/mm$^2$. If the tube is made of phosphor-deoxidized copper, the proof stress of the raw tube before groove formation is more preferably 380 N/mm$^2$ or less.

Proof-Stress/Tensile-Strength Ratio of Copper or Copper Alloy Tube Before Groove Formation: 0.65 to 0.95

If the proof-stress/tensile-strength ratio of the tube is less than 0.65, the tube is more likely to elongate at the portions thereof in contact with the rotating rolls and the wall thicknesses thereof are reduced excessively so that a rupture is more likely to occur. If the foregoing ratio is more than 0.95, on the other hand, the tube is less likely to elongate and the material is less likely to flow into the grooves in the grooved plugs so that the groove formability is reduced. To form the grooves having objective configurations, the pressing forces of the rolls and the tube drawing force should inevitably be increased so that the rupture of the tube is more likely to occur. Accordingly, the proof-stress/tensile-strength ratio of the tube before groove formation is adjusted to 0.65 to 0.95.

Since the present embodiment uses, as the raw tube before groove formation, a copper or copper alloy tube which is an unannealed H-material, has a proof stress of 200 to 500 N/mm$^2$, and has a proof-stress/tensile-strength ratio of 0.65 to 0.95, the rupture of the tube can be prevented when a seamless tube with a grooved inner surface is produced by a roll rolling method. Since a large extracting force can be applied, the processing speed can be increased to, e.g., 200 to 300 m/minute. This achieves reduced annealing cost, an improved yield rate, and increased productivity in the production of the tube with a grooved inner surface. Accordingly, the present embodiment allows the production of the tube with a grooved inner surface at lower production cost.

Since the present embodiment has rolled the tube with the two pairs of rolls, a groove can easily be formed in the entire inner surface of the tube by adjusting the amount of pressing by each pair of rolls.

A specific description will be given herein below to the effects of examples according to the embodiments of the present invention by making a comparison with comparative examples departed from the appended claims of the present invention.

Test 1

In the present test, the influence of the presence or absence of the sizing process on the occurrence of a protrusion was examined. Two tubes with grooved inner surfaces were produced by the foregoing method shown in the second embodiment. At that time, the sizing process was performed with respect to one of the tubes with grooved inner surfaces between primary rolling (rolling for groove formation using the rolls 3 and the grooved plug 9 shown in FIG. 2) and secondary rolling (rolling for groove formation using the rolls 5 and the grooved plug 11 shown in FIG. 2). In the sizing process, a die having an inner diameter of 7.80 mm was used. The other one of the tubes with grooved inner surfaces was produced without performing the sizing process with respect thereto.

Figure 15A:
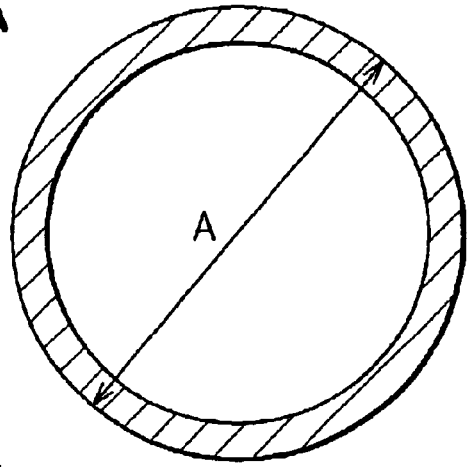
Figure 15B:
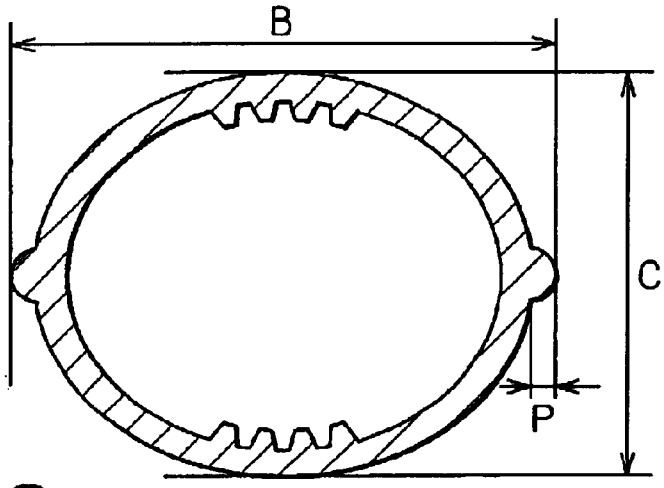
Figure 15C:
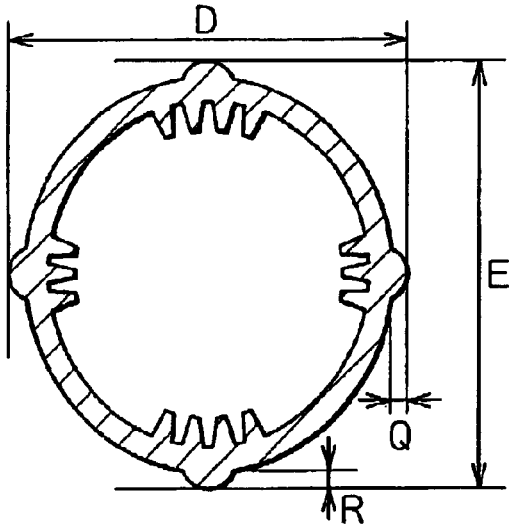
Figure 16A:
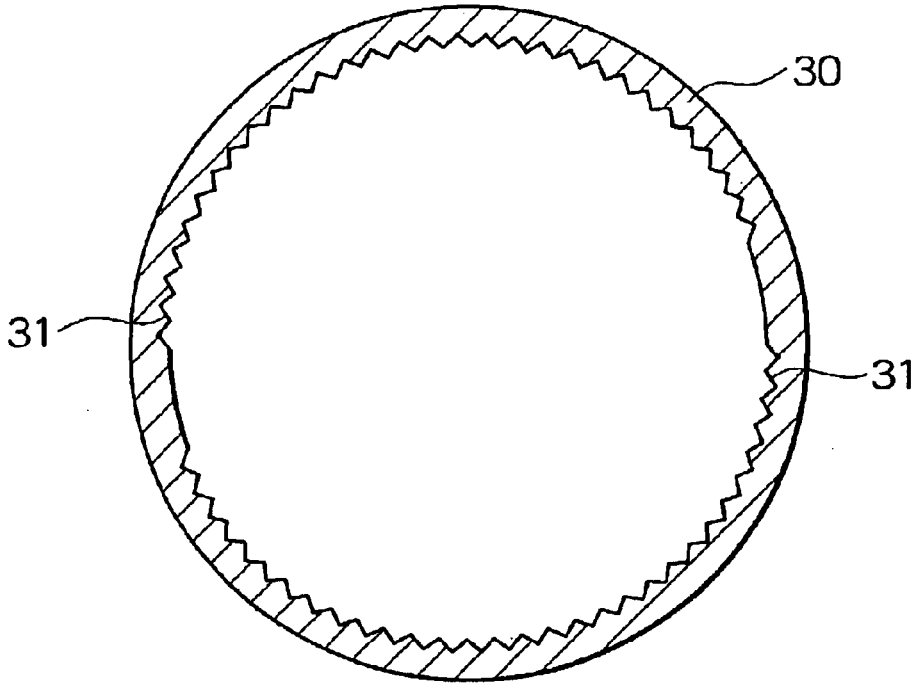
Figure 16B:
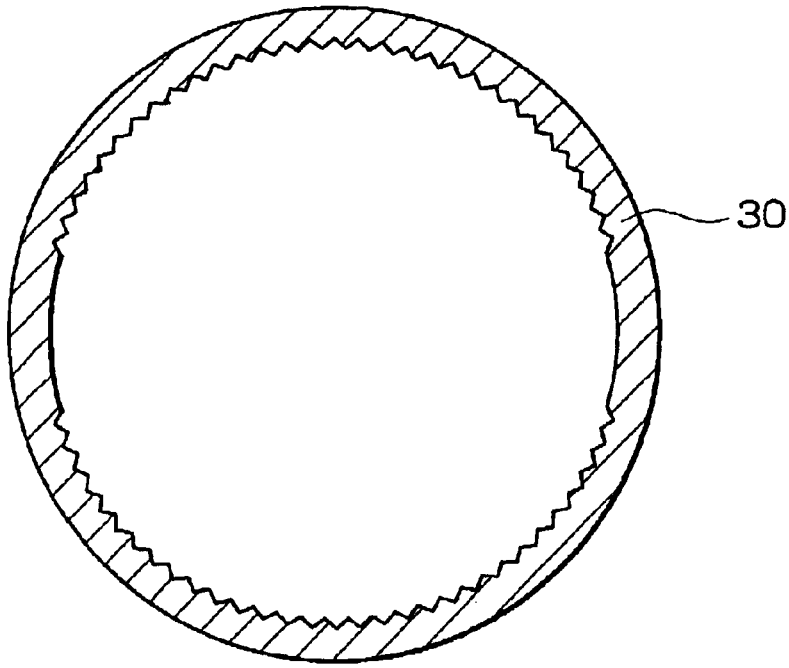

FIGS. 15A to 15C are cross-sectional views illustrating a testing method used in the present test, of which FIG. 15A shows the cross-sectional configuration of each of the tubes prior to primary rolling, FIG. 15B shows the cross-sectional configuration of each of the tubes after primary rolling and prior to the sizing process, and FIG. 15C shows the cross-sectional configuration of each of the tubes after secondary rolling. As shown in FIG. 15A, the diameter of the tube prior to primary rolling is designated by A. As shown in FIG. 15B, the long and short diameters of the tube after primary rolling and the height of the protrusion are designated by B, C, and P, respectively. As shown in FIG. 15C, the diameters of the tubes after secondary rolling are designated by D and E. The diameter D corresponds to the long diameter B prior to secondary rolling, while the diameter E corresponds to the short diameter C prior to secondary rolling. The height of the protrusion after secondary rolling, which was caused by primary rolling, is designated by Q and the height of the protrusion caused by secondary rolling is designated by R. The foregoing values were measured in each of the steps of producing the tubes with grooved inner surfaces. The results of measurement are shown in Table 2. The results of observing the cross-sectional configurations of the tubes with grooved inner surfaces by using an optical microscope are shown in FIGS. 16A and 16B.

TABLE 2

| | No. | Sizing Process | Before Primary Rolling Diameter A (mm) | Before Sizing Diameter B (mm) | Before Sizing Diameter C (mm) | Before Sizing Height P of Protrusion (mm) | After Secondary Rolling Diameter D (mm) | After Secondary Rolling Diameter E (mm) | After Secondary Rolling Height Q of Protrusion (mm) | After Secondary Rolling Height R of Protrusion (mm) |
|---|---|---|---|---|---|---|---|---|---|---|
| Example | 1 | Done | 8.75 | 8.41 | 8.09 | 0.22 | 7.79 | 7.78 | 0.02 | 0.02 |
| Comparative Example | 2 | Not Done | 8.74 | 8.42 | 7.98 | 0.20 | 7.80 | 7.79 | 0.02 | 0.25 |

The No. 1 shown in Table 2 indicates an example of the present invention. In Example No. 1, the height of the protrusion at the tube after secondary rolling was as small as 0.02 mm since the sizing process was performed between primary rolling and secondary rolling.

By contrast, No. 2 indicates a comparative example. In Comparative Example 2, the height R of the protrusion formed during secondary rolling was as large as 0.25 mm since the sizing process was not performed between primary rolling and secondary rolling.

FIGS. 16A and 16B show the result of observing the cross-sectional configurations of the tube with a grooved inner surface according to Example No. 1 by using a optical microscope, of which FIG. 16A shows the cross-sectional configuration of the tube after primary rolling and FIG. 16B shows the cross-sectional configuration of the tube after the sizing process and prior to secondary rolling. As shown in FIG. 16A, two protrusions 31 were observed at the tube 30 after primary rolling. By contrast, no protrusion was observed after the sizing process, as shown in FIG. 16B.

Test 2

Figure 17:
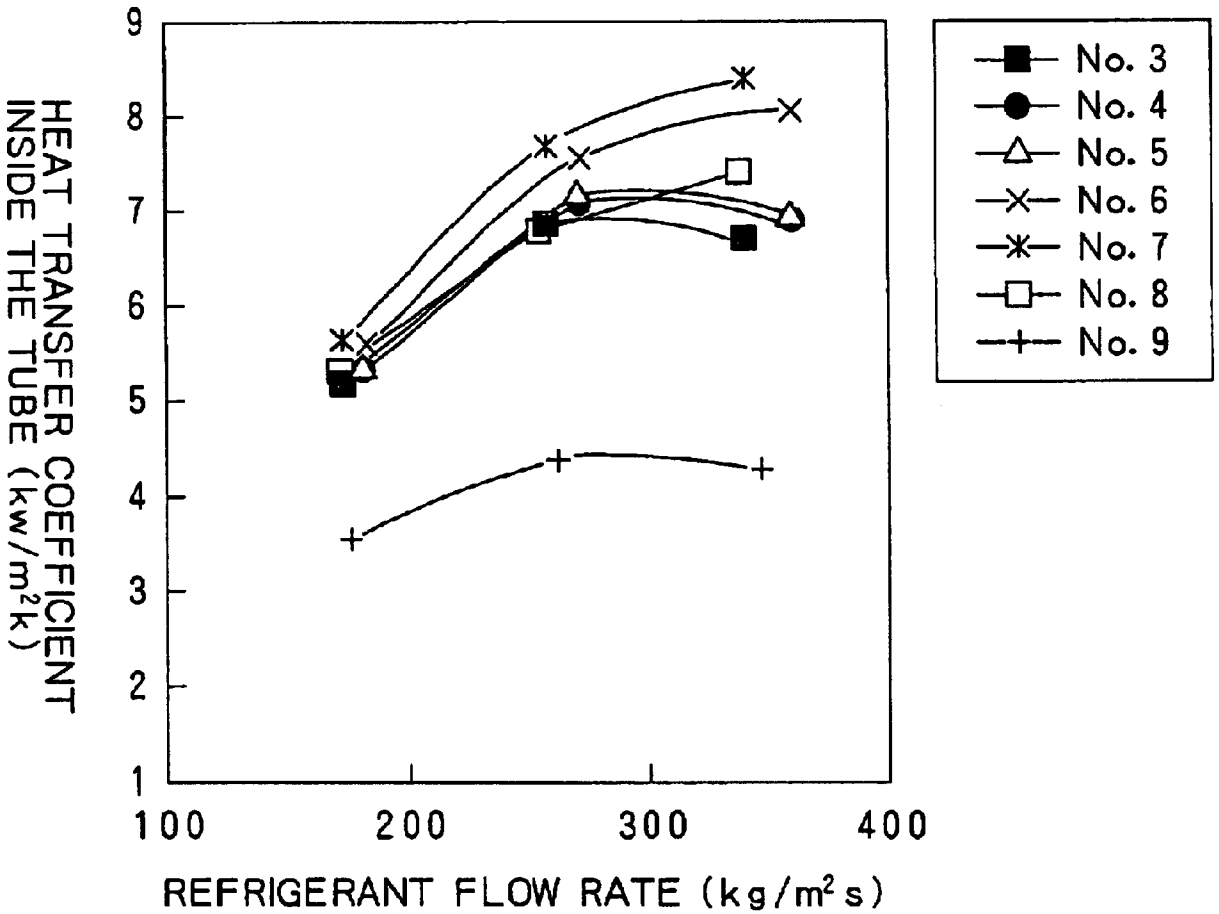
FIG. 17 is a graph showing the result of measuring evaporation performance in Test 2.
Figure 18:
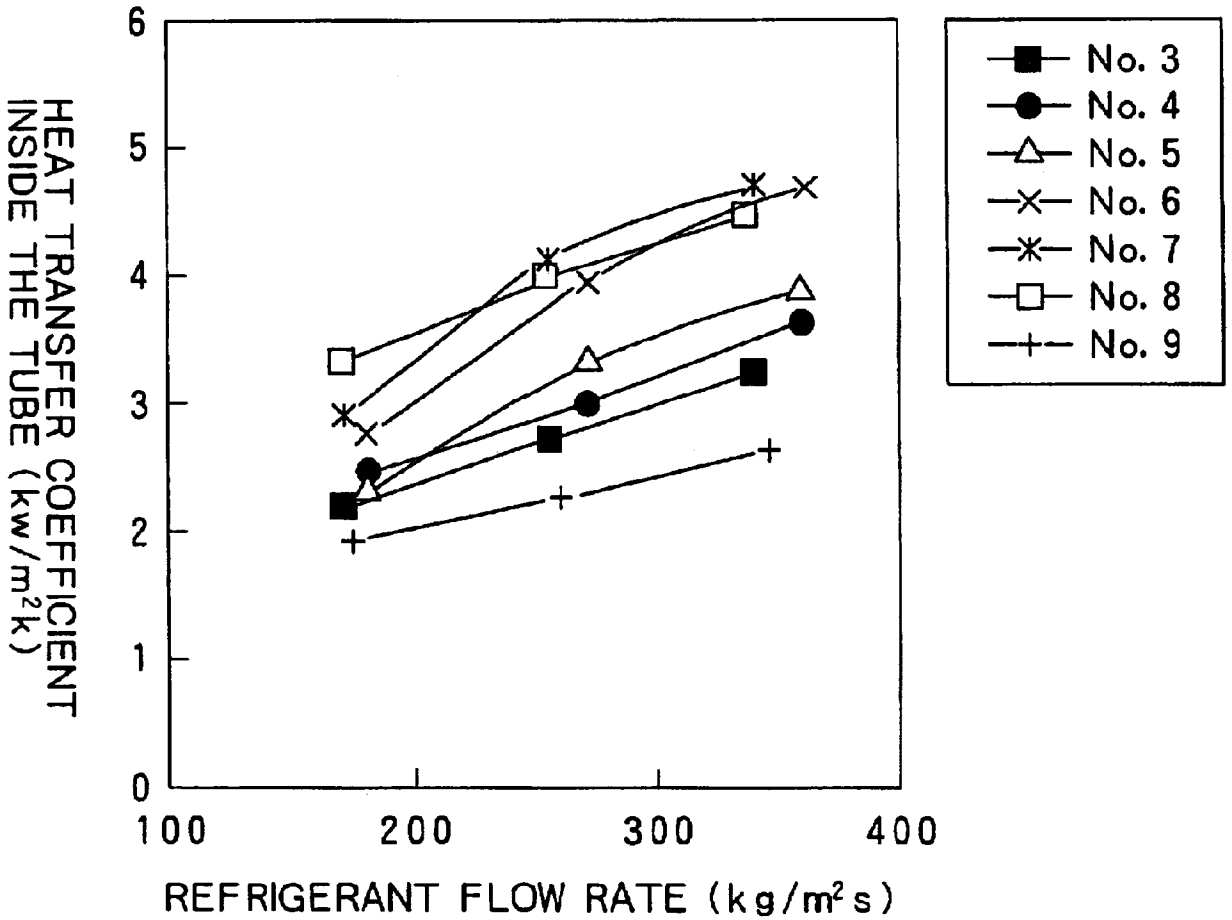
FIG. 18 is a graph showing the result of measuring condensation performance in Test 2.
Figure 19A:
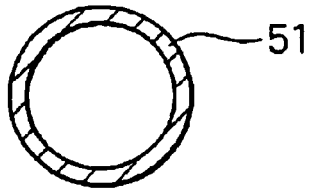
PRIOR ART FIG. 19A
FIGS. 19A to 19C are cross-sectional views showing a conventional method for producing a seamless tube with a grooved inner surface in accordance with a roll rolling method, which are orthogonal to the tube axis.
Figure 19B:
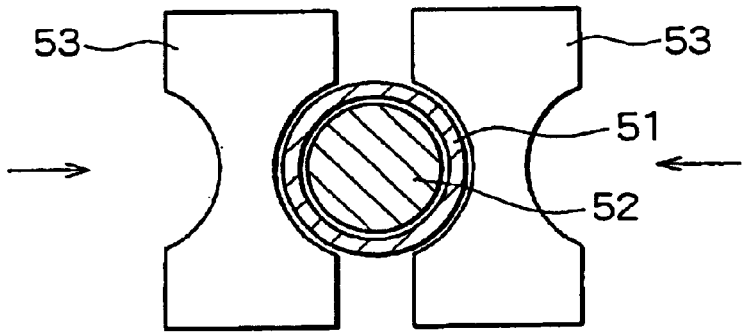
Figure 19C:
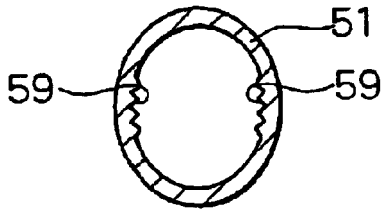

Tubes with grooved inner surfaces as shown in Table 3 were produced by the methods according to the foregoing second to seventh embodiments and the heat transfer performances thereof as heat transfer tubes were evaluated. Table 4 shows conditions for the measurement of the heat transfer performances. The regions 21 to 23 of the inner surfaces of the tubes shown in Table 3 are identical to the regions 21 to 23 shown in FIG. 8. Specifically, each of the regions 21 is a region in which a groove is formed during primary rolling, each of the regions 22 is a region in which a groove is formed during secondary rolling, and each of the regions 23 is a region between the regions 21 and 22. A straight groove indicates a groove having a lead angle of 0° and a spiral groove indicates a groove having a lead angle of other than 0° and inclined to the axial direction of the tube. However, the spiral groove need not necessarily be a groove formed in the entire inner surface of the tube and extending continuously in a spiral configuration. Cross grooves indicate a groove pattern composed of two kinds of grooves formed in crossing relation. The lead angles and the pitches shown in Table 3 indicate the lead angles and pitches of the grooves formed in the regions 21 and 22. In the region 23, each of the groove formed in the region 21 and the groove formed in the region 22 is formed. In the column of remarks in Table 3, the corresponding embodiments in the "embodiments of the present invention" described above are shown. As comparative examples, the heat transfer performances of a spiral grooved tube produced by a ball rolling method and a bare tube having no groove formed in the inner surface thereof were also measured. FIG. 17 is a graph showing the result of measuring evaporation performances. FIG. 18 is a graph showing the result of measuring condensation performances.

TABLE 3

| No. | Region of Inner Surface of Tube 21 | 22 | 23 | Fin Height (mm) | Bottom Wall Thickness (mm) | Lead Angle (°) | Pitch (mm) | Outer Diameter of Tube (mm) | Remarks |
|---|---|---|---|---|---|---|---|---|---|
| Example | | | | | | | | | |
| 3 | Straight Groove | Straight Groove | Straight Groove | 0.12 | 0.25 | 0 | 0.07 | 7.00 | Example 2 |
| 4 | Spiral Groove | Straight Groove | Cross Grooves | 0.12 | 0.25 | 13 | 0.04 | 7.00 | Example 4 |
| 5 | Spiral Groove to Right | Spiral Groove to Right | Spiral Groove to Right | 0.12 | 0.25 | 14 | 0.05 | 7.00 | Example 6 |
| 6 | Spiral Groove to Right | Spiral Groove to Left | Cross Grooves | 0.12 | 0.25 | 13 −12 | 0.05 | 7.00 | Example 6 |
| 7 | Spiral Groove with Low Pitch | Spiral Groove with High Pitch | Cross Grooves | 0.12 | 0.25 | 14 −13 | 0.04 0.24 | 7.00 | Example 7 |
| Comparative | | | | | | | | | |

TABLE 3-continued

| No. | Region of Inner Surface of Tube 21 | 22 | 23 | Fin Height (mm) | Bottom Wall Thickness (mm) | Lead Angle (°) | Pitch (mm) | Outer Diameter of Tube (mm) | Remarks |
|---|---|---|---|---|---|---|---|---|---|
| Example | | | | | | | | | |
| 8 | Spiral Groove | Spiral Groove | Spiral Groove | 0.15 | 0.25 | 18 | 0.20 | 7.00 | Ball Rolling Method |
| 9 | None | None | None | — | 0.25 | — — | — — | 7.00 | Bare Tube |

TABLE 4

| Evaporation Test | | Condensation Test | |
|---|---|---|---|
| Refrigerant in Use | R410A | Refrigerant in Use | R410A |
| Evaporation Temperature (° C.) | 7.5 | Condensation Temperature (° C.) | 45 |
| Degree of Dryness at Inlet of Tube under Test | 0.2 | Degree of Superheat at Inlet of Tube under Test (° C.) | 25 |
| Degree of Superheat at Outlet of Tube under Test (° C.) | 5 | Degree of Supercooling at Outlet of Tube under Test (° C.) | 5 |
| Water Flow Rate (m/second) | 1.5 | Water Flow Rate (m/second) | 1.5 |

Nos. 3 to 7 shown in Table 3 and in FIGS. 17 and 18 indicate the examples of the present invention. Each of the tubes with grooved inner surfaces according to Examples Nos. 3 to 7 was produced by a roll rolling method and having a plurality of groove patterns formed in the inner surfaces of the tubes. By contrast, Nos. 8 and 9 indicate comparative examples. Comparative Example No. 8 is a tube with a grooved inner surface having a spiral groove formed in the entire inner surface thereof by a ball rolling method. Comparative Example No. 9 is a bare tube having no groove formed in the inner surface thereof. As shown in FIGS. 17 and 18, the tubes with grooved inner surfaces according to Examples Nos. 3 to 7 were superior to the bare tube according to Comparative Example 9 in each of evaporation performance and condensation performance. In particular, Examples Nos. 6 and 7 were superior in evaporation performance to the tube with a grooved inner surface according to Comparative Example No. 8, which was produced by a ball rolling method. Accordingly, the tubes with grooved inner surfaces according to Examples Nos. 6 and 7 are used preferably and appropriately as heat transfer tubes to be incorporated into the heat exchangers of air conditioners designed specifically for cooling. The evaporation performances of the tubes with grooved inner surfaces according to Examples Nos. 3 to 5 and the condensation performances of the tubes with grooved inner surfaces according to Examples Nos. 3 to 7 were substantially equal to those of the tube with a grooved inner surface according to Comparative Example No. 8, which was produced by a ball rolling method. However, the tubes with grooved inner surfaces according to Examples 3 to 7, which were produced by a roll rolling method, can be fabricated at lower cost than the tube with a grooved inner surface according to Comparative Example 8, which was produced by a ball rolling method.

Test 3

Tubes with grooved inner surfaces as shown in FIG. 1 were produced by the methods shown in the foregoing individual embodiments. After processing, each of the tubes with grooved inner surfaces had an outer diameter of 7 mm, a bottom wall thickness of 0.25 mm, and a groove pitch of 0.07 mm. The grooves were formed in the regions 21 to 23 such that they had different lead angles and that fins between the grooves had different heights and different apex angles. At this stage, each of the tubes with grooved inner surfaces was evaluated for producibility. Next, a evaporation test and a condensation test were conducted on the producible tubes with grooved inner surfaces to evaluate the heat transfer performances thereof during evaporation and condensation. The evaporation test and the condensation test used the same conditions as used above in Test Example 2, which are shown in Table 4. At that time, the flow rate of a refrigerant was set to 270 kg/m$^2$ and the length of a measured material was set to 3.5 m. Table 5 shows the results of measuring the groove patterns, groove configurations, producibilities, and heat transfer performances of the tubes with grooved inner surfaces.

In Table 5, "Smooth" in the column of groove patterns indicates a smooth tube having no groove formed in the inner surface thereof, "Spiral" indicates that the grooves formed in the regions 21 (see FIG. 1) and the grooves formed in the regions 22 are inclined in the same direction relative to the straight line in the inner surface of the tube which is parallel to the tube axis. "Pine Needles" indicates that the grooves in the regions 21 and the grooves in the regions 22 are inclined in different directions. "Region" indicates the regions shown in FIG. 1. The line connecting the respective centers of the regions 21 in the circumferential direction of the tube extends vertically, while the line connecting the respective centers of the regions 22 in the circumferential direction of the tube extends horizontally. In the columns of the regions 21 to 23, "None" indicates that no groove is formed therein, "Straight" indicates that a groove having a lead angle of 0°, i.e., a groove extending in a direction parallel to the tube axis is formed, and each of "Spiral to Right" and "Spiral to Left" indicates that a groove having a lead angle more than 0° is formed. It is to be noted that "Spiral to Right" and "Spiral to Left" are different in the directions in which the grooves are inclined. "Cross Grooves" indicates that both the grooves formed in the regions 21 and the grooves formed in the regions 22 are formed in the regions 23.

In the column of producibility, the mark "○" indicates that a tube was producible and the mark "X" indicates that a tube was unproducible. Producibility was judged comprehensively from the presence or absence of the rupture of a raw tube under processing, the lifespans of processing tools, and the like. The values in the columns of evaporation and condensation of the result of measuring heat transfer performance are shown as relative values obtained as a result of measuring the evaporation performance and condensation performance of each of the tubes with grooved inner surfaces if the heat transfer performance of the smooth tube No. 11 shown in Table 5 is assumed to be 1. In "judgment", the mark "X" (Faulty) indicates the case where at least one of the evaporation performance and the condensation performance was less than 1.1, the mark "○" (Good) indicates the case where at least one of the evaporation performance and the condensation performance is 1.1 or more, and the mark "◎" (Excellent) indicates the case where each of the evaporation performance and the condensation performance was 1.25 or more

TABLE 5

| No. | Groove Pattern | Cross-Grooved Zone | Region 21 | Region 22 | Region 23 | Lead Angle (°) | Fin Height (mm) | Apex Angle (°) | Producibility |
|---|---|---|---|---|---|---|---|---|---|
| 11 | Smooth | — | None | None | None | — | 0.00 | — | ○ |
| 12 | Spiral | Absent | Straight | Straight | None | 0 | 0.12 | 90 | ○ |
| 13 | Spiral | Absent | Spiral to Right | Spiral to Right | None | 10 | 0.12 | 90 | ○ |
| 14 | Spiral | Absent | Spiral to Right | Spiral to Right | None | 19 | 0.12 | 90 | ○ |
| 15 | Spiral | Absent | Spiral to Right | Spiral to Right | None | 21 | 0.12 | 90 | X |
| 16 | Pine Needles | Absent | Spiral to Right | Spiral to Left | None | 5 | 0.12 | 90 | ○ |
| 17 | Spiral | Present | Spiral to Right | Spiral to Right | Cross Grooves | 5 | 0.12 | 90 | ○ |
| 18 | Pine Needles | Present | Spiral to Right | Spiral to Left | Cross Grooves | 5 | 0.12 | 90 | ○ |
| 19 | Spiral | Absent | Spiral to Right | Spiral to Right | None | 5 | 0.04 | 90 | ○ |
| 20 | Spiral | Absent | Spiral to Right | Spiral to Right | None | 5 | 0.05 | 90 | ○ |
| 21 | Spiral | Absent | Spiral to Right | Spiral to Right | None | 5 | 0.15 | 90 | ○ |
| 22 | Spiral | Absent | Spiral to Right | Spiral to Right | None | 5 | 0.16 | 90 | X |
| 23 | Spiral | Absent | Spiral to Right | Spiral to Right | None | 5 | 0.04 | 55 | X |
| 24 | Spiral | Absent | Spiral to Right | Spiral to Right | None | 5 | 0.05 | 60 | ○ |
| 25 | Spiral | Absent | Spiral to Right | Spiral to Right | None | 5 | 0.15 | 130 | ○ |
| 26 | Spiral | Absent | Spiral to Right | Spiral to Right | None | 5 | 0.16 | 137 | ○ |

| | Result of Measuring Heat Transfer Performance | | | |
|---|---|---|---|---|
| No. | Evaporation | Condensation | Judgment | |
| 11 | 1.00 | 1.00 | — | Comparative Example |
| 12 | 1.45 | 1.18 | ○ | Example |
| 13 | 1.52 | 1.21 | ○ | Example |
| 14 | 1.59 | 1.25 | ◎ | Example |
| 15 | — | — | — | Example |
| 16 | 1.58 | 1.25 | ◎ | Example |
| 17 | 1.60 | 1.26 | ◎ | Example |
| 18 | 1.62 | 1.25 | ◎ | Example |
| 19 | 1.02 | 1.01 | X | Example |
| 20 | 1.25 | 1.13 | ○ | Example |
| 21 | 1.58 | 1.25 | ◎ | Example |
| 22 | — | — | — | Example |
| 23 | — | — | — | Example |
| 24 | 1.62 | 1.30 | ◎ | Example |
| 25 | 1.44 | 1.19 | ○ | Example |
| 26 | 1.05 | 1.03 | X | Example |

Nos. 12 to 26 shown in Table 5 indicate the examples of the present invention. Since each of Nos. 12, 13, 14, 16, 17, 18, 20, 21, 24, and 25 was produced by a rolling process using hourglass-shaped rolls, having a lead angle of 20° or less, a fin height of 0.05 to 0.15 mm, and a fin apex angle of 60° to 130°, it can be produced at a high speed and was excellent in both evaporation performance and condensation performance.

By contrast, Example No. 11 shown in Table 5 indicates a comparative example to the present invention. The result of the test shows that Examples Nos. 15, 19, 22, 23, and 26 shown in Table 5 were slightly inferior in productivity and heat transfer performance to Examples Nos. 12, 13, 14, 16, 17, 18, 20, 21, 24, and 25.

Comparative Example No. 11 is a smooth tube having no groove formed in the inner surface thereof so that it was inferior in heat transfer performance to the tubes with grooved inner surfaces. Example No. 15 having a large lead angle of 21° was unproducible under these conditions. Example No. 19 having a small fin height of 0.04 mm was slightly inferior in heat transfer performance. Example No. 22 having a large fin height of 0.16 mm was unproducible under these conditions. Example No. 23 having a large apex angle of 55° was unproducible under these conditions. Example No. 26 having a large apex angle of 137° was slightly inferior in heat transfer performance. It is to be noted that Examples 15, 22, and 23 were producible if the producing conditions therefor were adjusted.

Test 4

The present test examined the case of using, as materials for forming tubes with grooved inner surfaces, a copper alloy (hereinafter referred to as the alloy A) having a composition of (Cu, 0.5 mass % of Sn, and 0.03 mass % of P), a copper alloy (hereinafter referred to as the alloy B) having a composition of (Cu, 0.8 mass % of Sn, 0.9 mass % of Zn, and 0.02 mass % of P), and a copper alloy (hereinafter referred to as the alloy C) defined in C1220 of JISH3300 and containing 0.025 mass % of P.

Tubes having grooved inner surfaces were produced by using the alloys as raw materials. Specifically, each of the alloys A, B, and C was cast into a billet and held at a temperature of 750° to 900° for 1 minute to 1 hour. Then, hot extrusion was performed at a temperature of 750° to 900°, followed by water cooling. At that time, a cooling rate in the temperature range of 700° to 300° C. was adjusted to 1.5° C./second or more. Then, the cooled materials were rolled and drawn, whereby raw tubes were produced. At that time, some of the raw tubes were annealed, while the other raw tubes were not annealed. The outer diameter and wall thickness of each of the tubes was adjusted to 10 mm and 0.33 mm, respectively. Table 9 shows the mechanical properties of the resulting raw tubes. A method for measuring the mechanical properties is as described above.

Next, the raw tubes were subjected to a roll rolling process and reduced in diameter, while grooves were formed in the inner surfaces thereof by using a producing apparatus shown in FIG. 2. The objective values of the configurations of the tubes with grooved inner surfaces are shown in Table 6. The processing speeds are shown in Table 9. During the processing, some of the tubes were ruptured and could not be processed any more. Thereafter, each of the tubes reduced in thickness and formed with grooves was wound around an LWC, annealed in an inert gas atmosphere, straightened, and cut off to have a specified length, whereby the tubes with grooved inner surfaces were produced. For the sake of comparison, tubes having grooved inner surfaces were produced also by a ball rolling method

TABLE 6

| Outer Diameter (mm) | Region Formed with Groove | Fin Height (mm) | Lead Angle (°) | Apex Angle (°) | Number of Grooves | Bottom Wall Thickness (mm) |
|---|---|---|---|---|---|---|
| 7 | All Around | 0.10 | 10 | 90 | 60 | 0.25 |

Next, a hairpin bending process with a 21-mm pitch was performed with respect to each of the produced tubes with grooved inner surfaces, whereby hairpin tubes were produced. Then, the hairpin tubes were inserted into holes in aluminum fins arranged in parallel to each other. To enhance the adhesion between the aluminum fins and the hairpin tubes, bead-like tube-expanding bullets each having a diameter slightly larger than the minimum inner diameter of each of the hairpin tubes was inserted into the hairpin tubes, thereby increasing the inner diameters of the hairpin tubes and expanding the tubes. Subsequently, a U-bend tube was coupled by using wax to the open end of each of the hairpin tubes such that a specified tubing path was formed, whereby heat exchangers were produced. Conditions for the heat exchangers were shown in Table 7.

TABLE 7

| | |
|---|---|
| Size of Heat Exchanger (mm) | 600 × 230 |
| Rows × Columns | 2 × 12 |

Next, the heat transfer performances of the heat exchangers were measured. Conditions for measuring the heat transfer performances are shown in Table 8. The result of measuring the heat transfer performances are shown as relative values by assuming that the heat transfer performance of the heat exchanger (see No. 9 in Table 9) in which a seamless tube with a grooved inner surface produced by a ball rolling method was 1. The heat transfer performance is a mean value of evaporation performance and condensation performance. The types of the alloys for forming the tubes with grooved inner surfaces, the presence or absence of an annealing process for each of the raw tubes before groove formation, mechanical properties, forming methods used in groove forming processes, processing speeds, processibilities, and heat transfer performances when incorporated into heat exchangers are shown in Table 5. In Table 9, "Forming Method" indicates a method for forming a groove in the inner surface of a tube, "Roll" indicates a rolling method implemented by roll rolling as shown in FIG. 2, and "Ball" indicates a conventional rolling method implemented by using a rolling ball. In "Processibility", the mark "○" indicates the case where no rupture occurred during processing and the mark "X" indicates the case where a rupture occurred during processing. In the case where a rupture occurred, the length between an end at which processing was initiated and a ruptured portion was shown in the column of "Ruptured Portion"

TABLE 8

| | Item | Condition |
|---|---|---|
| Refrigerant | — | R410A |
| — | | |
| Refrigerant Side | | |
| Evaporation | Reference Evaporation | 10 |

TABLE 8-continued

| | Item | Condition |
|---|---|---|
| | Temperature at Inlet (° C.) | |
| | Degree of Dryness at Inlet (° C.) | 0.2 |
| | Degree of Superheat at Outlet (° C.) | 5 |
| Condensation | Reference Condensation Temperature at Inlet (° C.) | 40 |
| | Temperature at Inlet (° C.) | |
| | Degree of Supercooling at Outlet (° C.) | 5 |
| Air Side | | |
| Evaporation | Dry-Bulb/Wet-Bulb Temperature (° C.) | 27/19 |
| | Wind Speed (m/s) | 0.8, 1.0, 1.2 |
| Condensation | Dry-Bulb/Wet-Bulb Temperature (° C.) | 20/15 |
| | Wind Speed (m/s) | 0.8, 1.0, 1.2 |

TABLE 9

| | | Raw Tube | | | | Groove Forming Process | | | | | |
|---|---|---|---|---|---|---|---|---|---|---|---|
| No. | Alloy | Anneal-ing | Proof Stress ($N/mm^2$) | Tensile Strength ($N/mm^2$) | Proof-Stress/ Tensile-Strength Ratio | Form-ing Method | Processing Speed (m/minute) | Process-ibility | Ruptured Portion | Heat Transfer Performance | |
| 1 | C | Not Done | 270 | 360 | 0.75 | Roll | 240 | ○ | — | 1.04 | Example |
| 2 | C | Done | 190 | 271 | 0.70 | Roll | 150 | X | 200 m | — | Comparative Example |
| 3 | C | Not Done | 205 | 289 | 0.71 | Roll | 200 | ○ | — | 1.03 | Example |
| 4 | C | Not Done | 390 | 397 | 0.98 | Roll | 160 | X | 300 m | — | Comparative Example |
| 5 | C | Not Done | 360 | 379 | 0.95 | Roll | 210 | ○ | — | 1.03 | Example |
| 6 | A | Not Done | 410 | 513 | 0.80 | Roll | 240 | ○ | — | 1.03 | Example |
| 7 | B | Not Done | 480 | 565 | 0.85 | Roll | 240 | ○ | — | 1.02 | Example |
| 8 | C | Done | 97 | 260 | 0.37 | Roll | 80 | X | 100 m | Comparative | Example |
| 9 | C | Done | 97 | 260 | 0.37 | Ball | 60 | ○ | — | 1.00 | Comparative Example |

Nos. 1, 3, 5, 6, and 7 shown in Table 9 indicate the examples of the present invention. Since the proof stresses of Examples Nos. 1, 3, 5, 6, and 7 before groove formation were 200 to 500 $N/mm^2$ and the proof-stress/tensile-strength ratios thereof were 0.65 to 0.95, no rupture occurred even when grooves were formed in the inner surfaces of the tubes by a roll rolling method so that processing was performed at a high speed of 200 m/minute or more. The heat transfer performances when the resultant tubes were incorporated in heat exchangers were also superior to those of the conventional tubes with grooved inner surfaces produced by a ball rolling method.

By contrast, Nos. 2, 4, 8, and 9 shown in Table 9 indicate comparative examples. In Comparative Example No. 2, the tube was ruptured at a position of 200 m after the initiation of a groove forming process performed by a roll rolling method since annealing had been performed with respect to the raw tube before groove formation and the proof stress of the raw tube was as low as 190 $N/mm^2$. In Comparative Example 4, the tube was ruptured at the position of 300 m after the initiation of a groove forming process performed by a roll rolling method since the proof-stress/tensile-strength ratio of the raw tube before groove formation was as high as 0.98. In Comparative Example No. 8, the tube ruptured at the position of 100 m after the initiation of processing performed by a roll rolling method at a low processing speed of 80 m/minute since annealing was performed with respect to the raw tube before groove formation, the proof resistance of the raw tube was as low as 97 $N/mm^2$, and the proof-stress/tensile-strength ratio was as low as 0.37. In Comparative Example 9, a tube with a grooved inner surface was produced by a ball rolling method. To form a grooved inner surface by a ball rolling method, it was inevitable to use an annealed material as a raw tube and adjust the processing speed to a low rate of 60 m/minute so that Comparative Example 9 was inferior in productivity. Compared with the examples of the present invention, the heat transfer performance of a heat exchanger according to Comparative Example 9 was also inferior.

What is claimed is:

1. A method for producing a seamless tube with a grooved inner surface, comprising the steps of:

drawing a metal tube to gradually reduce a diameter of the metal tube by means of a holding die disposed externally of the metal tube and a holding plug disposed internally of the tube and engaged with the holding die;

rotating a plurality of first rolls in contact with an outer surface of the metal tube with a reduced diameter such that a rotation axis of each of the first rolls is orthogonal to an axial direction of the metal tube, while disposing, at a position inside the metal tube corresponding to the first rolls, a first grooved plug formed with a grooved outer surface and coupled in relatively rotatable relation to the holding die via a first coupling shaft, and pressing the metal tube against the first grooved plug by means of the first rolls to form a first groove in a portion of an inner surface of the metal tube in a circumferential direction of the tube and thereby form a plurality of first grooved zones;

performing a sizing process with respect to the metal tube formed with the first grooved zones by using a sizing device; and rotating a plurality of second rolls in contact with the outer surface of the metal tube such that a rotation axis of each of the second rolls is orthogonal to the axial direction of the metal tube and deviates from the rotation axis of each of the first rolls, while disposing, at a position inside the metal tube corresponding to the second rolls, a second grooved plug formed with a grooved outer surface and coupled in relatively rotatable relation to the first grooved plug via a second coupling shaft, and pressing the metal tube against the second grooved plug by means of the second rolls to form a second groove in a portion of the inner surface of the metal tube in the circumferential direction of the tube and thereby form a plurality of second grooved zones.

2. The method according to claim 1, wherein a groove is not formed in a region of the inner surface of the metal tube located between the first and second grooved zones.

3. The method according to claim 2, wherein a direction in which the groove formed in the outer surface of the first grooved plug extends is the same as a direction in which the groove formed in the outer surface of the second grooved plug extends and a configuration and pitch of the groove formed in the outer surface of the first grooved plug are equal to a configuration and pitch of the groove formed in the outer surface of the second grooved plug.

4. The method according to claim 1, wherein the sizing process is a diameter reducing process using a die or a roll.

5. The method according to claim 1, wherein an even number of first rolls and an even number of second rolls are provided and disposed in mutually opposing relation with the metal tube interposed therebetween.

6. The method according to claim 1, wherein each of respective directions in which the grooves formed in the first and second grooved plugs extend is parallel to the axial direction of the tube or inclined at an angle of 0° to 30° to the axial direction of the tube.

7. The method according to claim 1, further comprising, after the step of forming the second grooved zone, the step of performing a diameter reducing process with respect to the metal tube by bringing a finishing die into contact with the outer surface of the metal tube.

8. The method according to claim 1, wherein respective circumferential speeds of at least one of the first rolls and the second rolls are adjusted to be higher than a speed at which the metal tube is drawn.

9. The method according to claim 1, wherein the respective regions of the inner surface of the metal tube formed with the first and second grooved zones are in alignment with the respective regions of the outer surface of the metal tube in contact with the first and second rolls.

10. The method according to claim 1, wherein the first rolls are composed of at least one pair of hourglass-shaped rolls and the second rolls are composed of at least one pair of hourglass-shaped rolls.

11. The method according to claim 1, wherein the metal tube is composed of copper or a copper alloy.

12. The method according to claim 11, wherein a proof stress of the metal tube composed of copper or a copper alloy before the grooves are formed in the metal tube is 200 to 500 $N/mm^2$ and a proof-stress/tensile-strength ratio of the metal tube before the grooves are formed in the metal tube is 0.65 to 0.95.

13. The method according to claim 11, further comprising the step of reducing the diameter of the metal tube formed with the first groove.

14. The method according to claim 11, further comprising the step of reducing the diameter of the metal tube formed with the second groove.

* * * * *

UNITED STATES PATENT AND TRADEMARK OFFICE

CERTIFICATE OF CORRECTION

PATENT NO. : 6,834,523 B2
APPLICATION NO. : 10/328030
DATED : December 28, 2004
INVENTOR(S) : Hinago et al.

It is certified that error appears in the above-identified patent and that said Letters Patent is hereby corrected as shown below:

On the title page, Item (73), should read:

-- (73) Assignee: Kabushiki Kaisha Kobe Seiko Sho (Kobe Steel, Ltd.), Kobe (JP) --

Signed and Sealed this

Sixth Day of March, 2007

JON W. DUDAS
*Director of the United States Patent and Trademark Office*